US009693636B2

(12) United States Patent
Yang

(10) Patent No.: US 9,693,636 B2
(45) Date of Patent: Jul. 4, 2017

(54) INFANT CHAIR ASSEMBLY INCLUDING A REMOVABLE INFANT CARRIER

(71) Applicant: Wonderland Nurserygoods Company Limited, Kwai Chung, N.T. (HK)

(72) Inventor: Tao Yang, Kwai Chung (HK)

(73) Assignee: Wonderland Nurserygoods Company Limited (HK)

( * ) Notice: Subject to any disclaimer, the term of this patent is extended or adjusted under 35 U.S.C. 154(b) by 263 days.

(21) Appl. No.: 14/565,627

(22) Filed: Dec. 10, 2014

(65) Prior Publication Data

US 2015/0157140 A1 Jun. 11, 2015

(30) Foreign Application Priority Data

Dec. 11, 2013 (CN) ..... 2013 1 0671399
Apr. 10, 2014 (CN) ..... 2014 1 0143926

(51) Int. Cl.

| | |
|---|---|
| ***A47D 13/02*** | (2006.01) |
| ***A47D 1/00*** | (2006.01) |
| ***A47D 15/00*** | (2006.01) |
| ***A47D 7/04*** | (2006.01) |

(52) U.S. Cl.

CPC ..... *A47D 13/02* (2013.01); *A47D 1/00* (2013.01); *A47D 1/008* (2013.01); *A47D 7/04* (2013.01); *A47D 15/006* (2013.01)

(58) Field of Classification Search

None

See application file for complete search history.

(56) References Cited

U.S. PATENT DOCUMENTS

| | | | |
|---|---|---|---|
| 5,413,399 A | 5/1995 | Myers et al. | |
| 6,715,828 B1 | 4/2004 | Cheng | |
| 6,983,986 B2 * | 1/2006 | Jane Santamaria .... | A47D 13/02 297/130 |

(Continued)

FOREIGN PATENT DOCUMENTS

| | | |
|---|---|---|
| AT | 325801 | 6/1974 |
| DE | 102004033333 A1 | 1/2006 |

OTHER PUBLICATIONS

Office Action in DE Application No. 10 2014 118 357.6 dated Jun. 11, 2015.

(Continued)

*Primary Examiner* — David E Allred

(74) *Attorney, Agent, or Firm* — Baker & McKenzie LLP; David I. Roche

(57) ABSTRACT

An infant chair assembly includes an infant chair, and an infant carrier installed on the infant chair in a transversally oriented configuration. The infant carrier includes a shell body adapted to be placed on the infant chair, and an anchor mechanism operable to fasten with the infant chair. The anchor mechanism includes a rotary shaft pivotally connected with the shell body, a release member slidably connected with the shell body and operatively connected with the rotary shaft, two engaging arms affixed with the rotary shaft, and the two engaging arms respectively having hooks operable to engage with the infant chair for locking the infant carrier in place on the infant chair. Actuation of the release member can drive rotation of the rotary shaft and the engaging arms for disengaging the hooks from the infant chair.

9 Claims, 21 Drawing Sheets

(56) References Cited

U.S. PATENT DOCUMENTS

| | | | | |
|---|---|---|---|---|
| 8,070,228 | B2 * | 12/2011 | Karremans | B60N 2/2821 297/256.16 |
| 2009/0315374 | A1 * | 12/2009 | Hu | A47D 1/004 297/256.16 |
| 2009/0315375 | A1 * | 12/2009 | Hu | A47D 15/006 297/256.16 |
| 2009/0315379 | A1 * | 12/2009 | Jacobs | A47D 1/004 297/344.18 |
| 2013/0214571 | A1 | 8/2013 | Opsvik et al. | |
| 2013/0326808 | A1 * | 12/2013 | Saint | A47D 5/00 5/93.1 |

OTHER PUBLICATIONS

Official Action from UK Patent Application No. GB1421919.0 dated May 13, 2015.
Office Action in co-pending DE Application No. 10 2014 118 357.6 dated Jun. 11, 2015.
English Translation of Office Action in co-pending DE Application No. 10 2014 118 357.6 dated Jun. 11, 2015.

* cited by examiner

INFANT CHAIR ASSEMBLY INCLUDING A REMOVABLE INFANT CARRIER

CROSS-REFERENCE TO RELATED APPLICATION(S)

This patent application respectively claims priority to Chinese Patent Application No. 201310671399.1 filed on Dec. 11, 2013, and to Chinese Patent Application No. 201410143926.6 filed on Apr. 10, 2014, which are incorporated herein by reference.

BACKGROUND

1. Field of the Invention

The present invention relates to an infant chair assembly including a removable infant carrier.

2. Description of the Related Art

Infant chairs are a very common type of juvenile furniture. Examples of infant chairs include a high chair on which a young child can be installed for feeding. The high chair may include a guard member to prevent falling of the child. Other types of infant chairs may have no guard member to facilitate interaction of the child with the caregiver.

On the other hand, a bassinet is typically used to provide a comfortable and safe environment for soothing and sleeping the child. Examples of bassinets can include stationary bassinets having standing legs, and portable bassinets having no standing legs.

The bassinet and the infant chair are usually designed as separate devices that are used independently from each other. Accordingly, parents generally have to purchase multiple juvenile furniture items to accommodate the different care needs. The multiple furniture items require more storage space, and increase the expense.

Therefore, there is a need for an improved infant chair design that is more flexible in use, and can address at least the foregoing issues.

SUMMARY

The present application describes an infant chair assembly can include a removable infant carrier, and offer more flexibility in use. In one embodiment, the infant carrier includes a shell body adapted to be placed on an infant chair, and an anchor mechanism assembled with the shell body and operable to fasten with the infant chair. The anchor mechanism includes a rotary shaft pivotally connected with the shell body, a release member slidably connected with the shell body and operatively connected with the rotary shaft, and two engaging arms affixed with the rotary shaft, the two engaging arms respectively having hooks operable to engage with the infant chair for locking the infant carrier in place on the infant chair. Actuation of the release member drives rotation of the rotary shaft and the engaging arms for disengaging the hooks from the infant chair.

The present application further describes an infant chair assembly including an infant chair, and an infant carrier installed on the infant chair. The infant chair has a plurality of standing legs, a seat portion, a backrest connected with the seat portion, and a left and a right side. The infant carrier is fastened to the infant chair via a plurality of anchor mechanisms, and has a head and a foot region respectively corresponding to the head and feet of a child placed on the infant carrier. The infant carrier is arranged on the infant chair with the head and foot regions oriented along a transversal axis extending from a left to a right side of the infant chair.

DETAILED DESCRIPTION OF THE EMBODIMENTS

Figure 1:
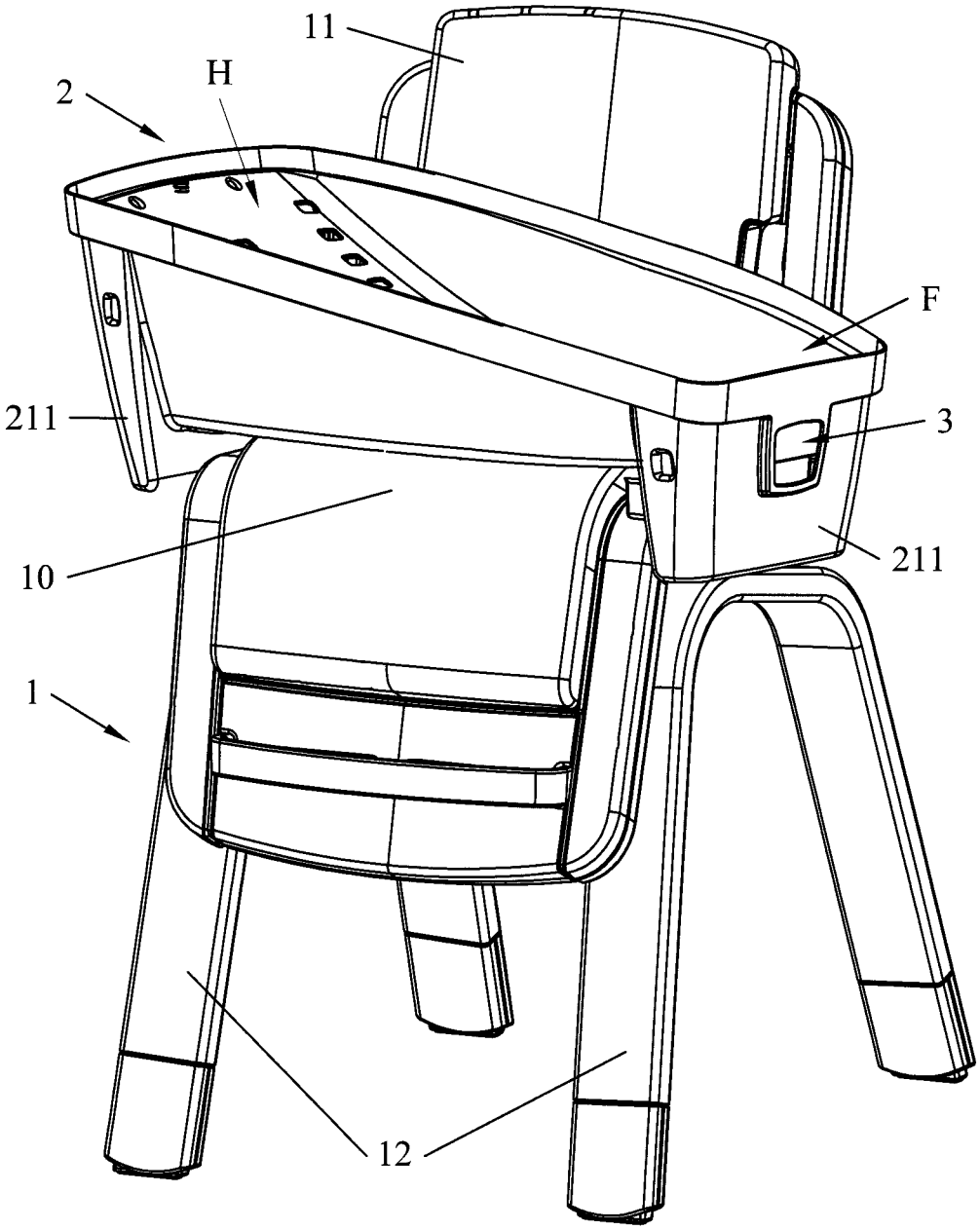
FIG. 1 is a perspective view illustrating an infant chair assembly including a removable infant carrier.
Figure 2:
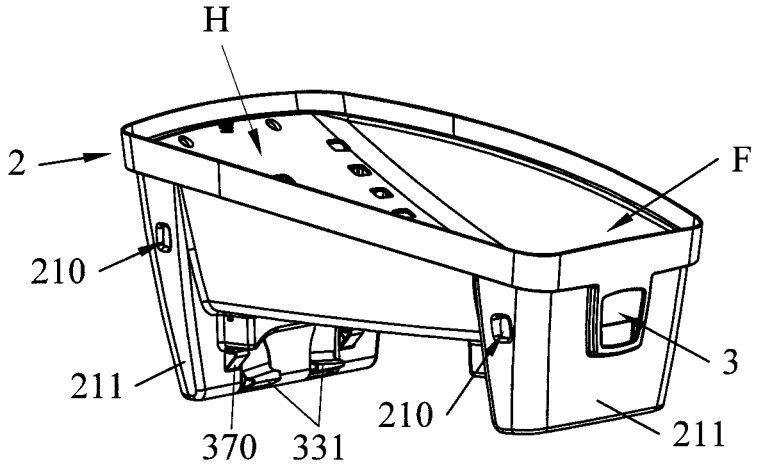
FIG. 2 is a schematic view illustrating the infant carrier separated from the infant chair.
Figure 2:
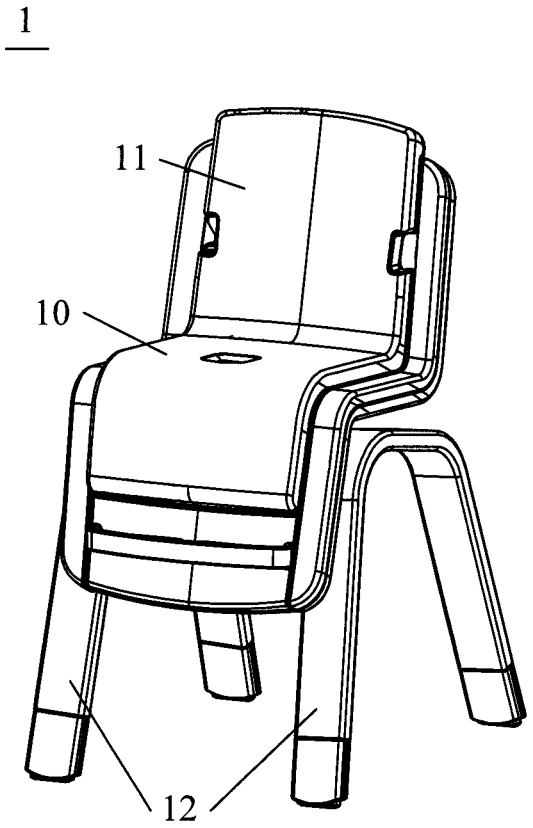

FIGS. 1 and 2 are schematic views illustrating an embodiment of an infant chair assembly. The infant chair assembly can include an infant chair 1, and an infant carrier 2 that can be removably installed on the infant chair 1. The infant chair 1 can have a seat portion 10 on which a child can sit, a backrest 11 and four standing legs 12. The standing legs 12 can provide support for the seat portion 10, and the backrest 11 is affixed with the seat portion 10 at a rear thereof. The backrest 11 can extend substantially perpendicular to the seat portion 10, so that a child sitting on the seat portion 10 can have the back supported in an upright position by the backrest 11. The infant chair 1 can typically be an infant high chair. The infant carrier 2 can have two anchor mechanisms 3 that can engage with the seat portion 10 to lock the infant carrier 2 in place on the seat portion 10.

Figure 3:
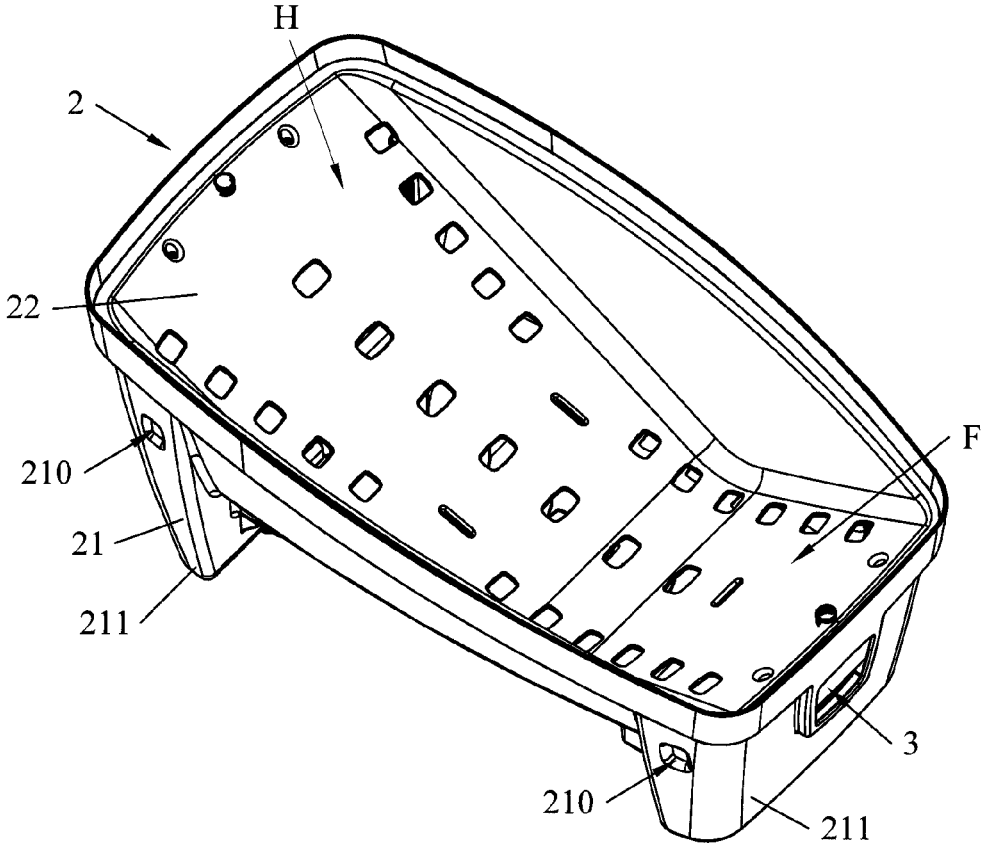
FIG. 3 is a schematic view illustrating the infant carrier alone.
Figure 4:
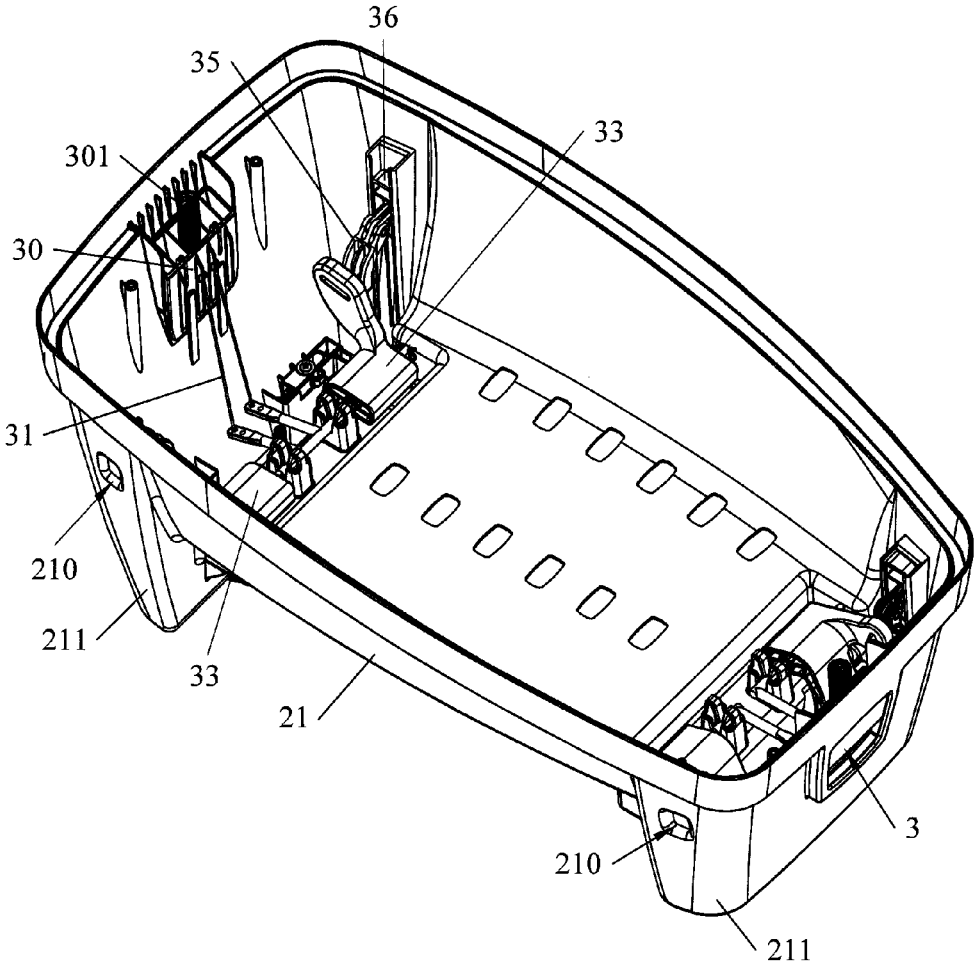
FIG. 4 is a schematic view illustrating an interior of the infant carrier provided with two anchor mechanisms operable to engage with the infant chair.

FIG. 3 is a schematic view illustrating a construction of the infant carrier 2. The infant carrier 2 can include a shell body formed by the assembly of a lower shell portion 21 and an upper shell portion 22. The lower shell portion 21 can define an inner cavity, and the upper shell portion 22 can be affixed with the lower shell portion 21 so as to upwardly cover the inner cavity of the lower shell portion 21. Moreover, a cushion can be arranged on the upper shell portion 22 to provide comfortable resting support for a child. In one embodiment, the infant carrier 2 can be exemplary a portable basket or crib adapted to receive a child in a lying position on the upper shell portion 22 (i.e., the back of the child can be supported by the upper shell portion 22), the head of the child being placed near a head region H of the infant carrier 2, and the feet of the child being placed near a foot region F of the infant carrier 2. The upper surface of the upper shell portion 22 that supports the child can be inclined to provide comfortable support. When the infant carrier 2 is installed on the infant chair 1, the standing legs 12 can provide stable support for the infant carrier 2 at an elevated position for facilitating care dispensing to a child received in the infant carrier 2. After they are detached from each other, the infant chair 1 and the infant carrier 2 can be separately used as independent devices.

In conjunction with FIG. 3, FIGS. 4-6 are schematic views illustrating the anchor mechanisms 3 provided in the infant carrier 2. The two anchor mechanisms 3 can be respectively disposed at two opposite sides of the lower shell portion 21 near the foot region F and the head region H of the infant carrier 2, and can be operable to attach with the seat portion 10 of the infant chair 1. The two anchor mechanisms 3 can be similar in construction. Each of the anchor mechanisms 3 can include a release member 30, two link members 31, a rotary shaft 32, two engaging arms 33, two springs 34, two linkage parts 35, two state indicator members 36, and a detent assembly comprised of two actuator members 37 and two detents 38.

The release member 30 can be assembled with an inner sidewall of the lower shell portion 21 for up and down sliding displacement, and can be exposed outward through the lower shell portion 21 for operation by a caregiver. In one embodiment, the inner sidewall of the lower shell portion 21 can have two ribs transversally spaced-apart from each other, and the release member 30 can be guided for sliding displacement between the two ribs. In addition, this same inner sidewall of the lower shell portion 21 may be further affixed with a positioning post that projects toward the release member 30 and can restrict its displacement between the two ribs.

The rotary shaft 32 can be pivotally connected with the lower shell portion 21 near its bottom and below the release member 30. The rotary shaft 32 can be affixed with two radial extensions 321 having an elongated shape that projects toward the inner sidewall of the lower shell portion 21 where is assembled the release member 30.

Figure 7:
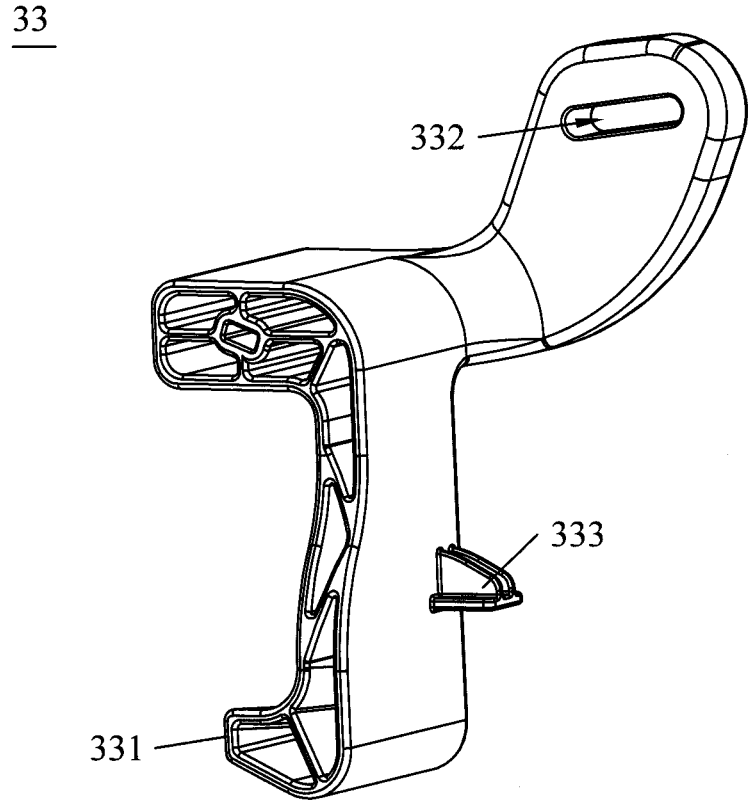
FIG. 7 is a schematic view illustrating an engaging arm used in the anchor mechanism shown in FIG. 5.

The two engaging arms 33 can be respectively affixed with two opposite end portions of the rotary shaft 32, the two radial extensions 321 being arranged in a region between the two engaging arms 33. FIG. 7 is a schematic view illustrating the construction of one engaging arm 33. Each of the two engaging arms 33 can have an upper portion affixed with the rotary shaft 32, and a lower portion extending below the rotary shaft 32 that can form a hook 331 operable to extend outside the lower shell portion 21 for engaging with the seat portion 10 of the infant chair 1. The hook 331 can bend at a side of the engaging arm 33 opposite to that of the release member 30. Moreover, each engaging arm 33 can be formed with a protrusion 333 that is eccentric from the axis of the rotary shaft 32 and projects at a side opposite to that of the hook 331. The two engaging arms 33 can be driven in rotation by the rotary shaft 32 in a first direction for causing the hooks 331 to engage with the seat portion 10 of the infant chair 1, and in a second direction opposite to the first direction for causing the hooks 331 to disengage from the seat portion 10 of the infant chair 1.

Each of the two link members 31 can have a first end affixed with the release member 30, and a second end affixed with a corresponding one of the two radial extensions 321 of the rotary shaft 32. The link members 31 can be exemplary wires or cables that connect the release member 30 to the rotary shaft 32. The use of wires or cables occupies less space, and can facilitate movement transmission between the different parts. Accordingly, an upward displacement of the release member 30 can pull on the link members 31, which drive rotation of the rotary shaft 32 in the second direction for causing the hooks 331 of the engaging arms 33 to disengage from the seat portion 10.

A spring 301 may be respectively connected with the release member 30 and the shell body of the infant carrier 2 (e.g., lower or upper shell portion 21, 22). The spring 301 can bias the release member 30 downwardly. When the release member 30 is no longer actuated by a caregiver, the spring 301 can urge the release member 30 to recover an initial position corresponding to a locking state.

The two springs 34 can respectively connect the two radial extensions 321 of the rotary shaft 32 to the lower shell portion 21. When the infant carrier 2 is installed on the infant chair 1, the springs 34 can bias the rotary shaft 32 to rotate in the first direction for driving the engaging arms 33 to automatically engage and lock with the seat portion 10 of the infant chair 1.

Referring again to FIGS. 5 and 6, an upper portion of each engaging arm 33 can have a flat shape formed with an inclined slot 332. The state indicator members 36 can be slidably assembled with the lower shell portion 21. The sliding assembly of each state indicator member 36 can use, for example, a structure similar to that of the release member 30.

The two linkage parts 35 can respectively connect the two state indicator members 36 to the two engaging arms 33. More specifically, each linkage part 35 can have a first end that is guided for sliding displacement in the inclined slot 332 of one engaging arm 33, and a second end pivotally connected with one state indicator member 36. When the rotary shaft 32 drives the engaging arms 33 in rotation, the respective inclined slots 332 can move along with the engaging arms 33 and respectively drive the linkage parts 35 to concurrently move upward or downward, which in turn respectively drive sliding of the state indicator members 36 relative to the lower shell portion 21. Each of the state indicator members 36 can have a surface provided with two visually distinctive regions 361 and 362 that are disposed on top of each other. For example, the two regions 361 and 362 may have different colors, patterns, words or other markings.

In one embodiment, the first region 361 can be exemplary green colored, and the second region 362 can be exemplary red colored. The lower shell portion 21 can have two display windows 210 respectively arranged adjacent to the two state indicator members 36. Each of the display windows 210 can expose either of the first and second regions 361 and 362.

When the engaging arms 33 are in the unlocking state, the linking parts 35 can be respectively located at the upper regions of the inclined slots 332, and the second regions 362 of red color on the state indicator members 36 can respectively display at the display windows 210. Once the engaging arms 33 fasten with the seat portion 10, the linking parts 35 can respectively slide to the lower regions of the inclined slots 332, and the state indicator members 36 can accordingly slide to have the first regions 361 of green color respectively displayed at the display windows 210 for visually indicating the locking state.

It is worth noting that alternate embodiments can omit the linking parts 35 and directly affix the state indicator members 36 to the rotary shaft 32. Such state indicator members 36 can likewise operate to visually indicate whether the engaging arms 33 are in the unlocking or locking state.

Referring to FIGS. 5-8, a detent assembly can be provided to keep the engaging arms 33 in the unlocking state when the infant carrier 2 is not installed on the seat portion 10, and to disengage from the engaging arms 33 so as to allow its locking displacement when the infant carrier 2 is installed on the seat portion 10. The detent assembly can be arranged adjacent to the engaging arms 33, and can include two actuator members 37 and two detents 38.

The two actuator members 37 can be positioned in the lower shell portion 21 spaced apart from each other along the axis of the rotary shaft 32, and are respectively adjacent to the two engaging arms 33. The actuator members 37 can be assembled for sliding substantially orthogonal to the axis of the rotary shaft 32 along a direction extending from one of the two anchor mechanisms 3 toward the other anchor mechanism 3. Each actuator member 37 can be formed as an integral part, and can have a first end that extends outside the lower shell portion 21 and is formed with a bevel surface 370 inclined downward. The bevel surface 370 can be located adjacently above the hook 331 of the engaging arm 33.

Figure 8:
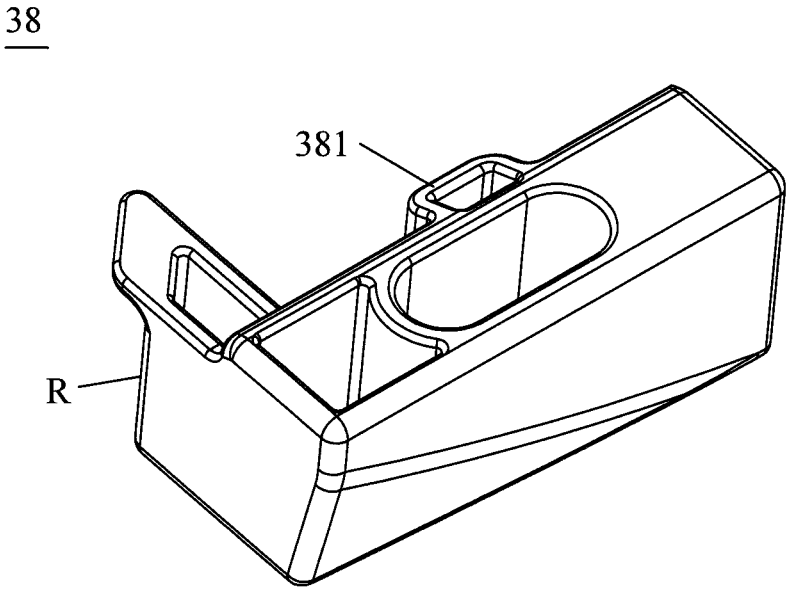
FIG. 8 is a schematic view illustrating a detent used in the anchor mechanism shown in FIG. 5.

The two detents 38 are arranged respectively adjacent to the two actuator members 37 and behind the engaging arms 33 (i.e., at side opposite to that of the hooks 331), each pair of one detent 38 and one actuator member 37 associated therewith forming a generally L-shaped arrangement. The two detents 38 can be assembled in the lower shell portion 21 for sliding alongside the rotary shaft 32. FIG. 8 is a schematic view illustrating the construction of one detent 38. Each of the two detents 38 can be formed as an integral part, and can have a protrusion 381 projecting toward the corresponding engaging arm 33. The protrusion 381 of the detent 38 can contact with an underside of the protrusion 333 of the corresponding engaging arm 33 so as to block a locking rotation of the engaging arm 33 induced by the spring 34. Moreover, each of the two detents 38 can have a ramp surface R that is in sliding contact with a counterpart ramp surface R' provided on the actuator member 37 associated therewith. The orientation of these ramp surfaces R and R' is such that a sliding displacement of the actuator members 37 toward the detents 38 and the interior of the lower shell portion 21 can respectively urge the detents 38 to slide toward each other for respectively disengaging the protrusions 381 of the detents 38 from the underside of the protrusions 333 of the engaging arms 33.

Referring again to FIG. 6, two springs 382 can be respectively connected with the two detents 38 and the lower shell portion 21. The springs 382 can urge the detents 38 away from each other for positioning the protrusions 381 in abutment with the protrusions 333.

Figure 5:
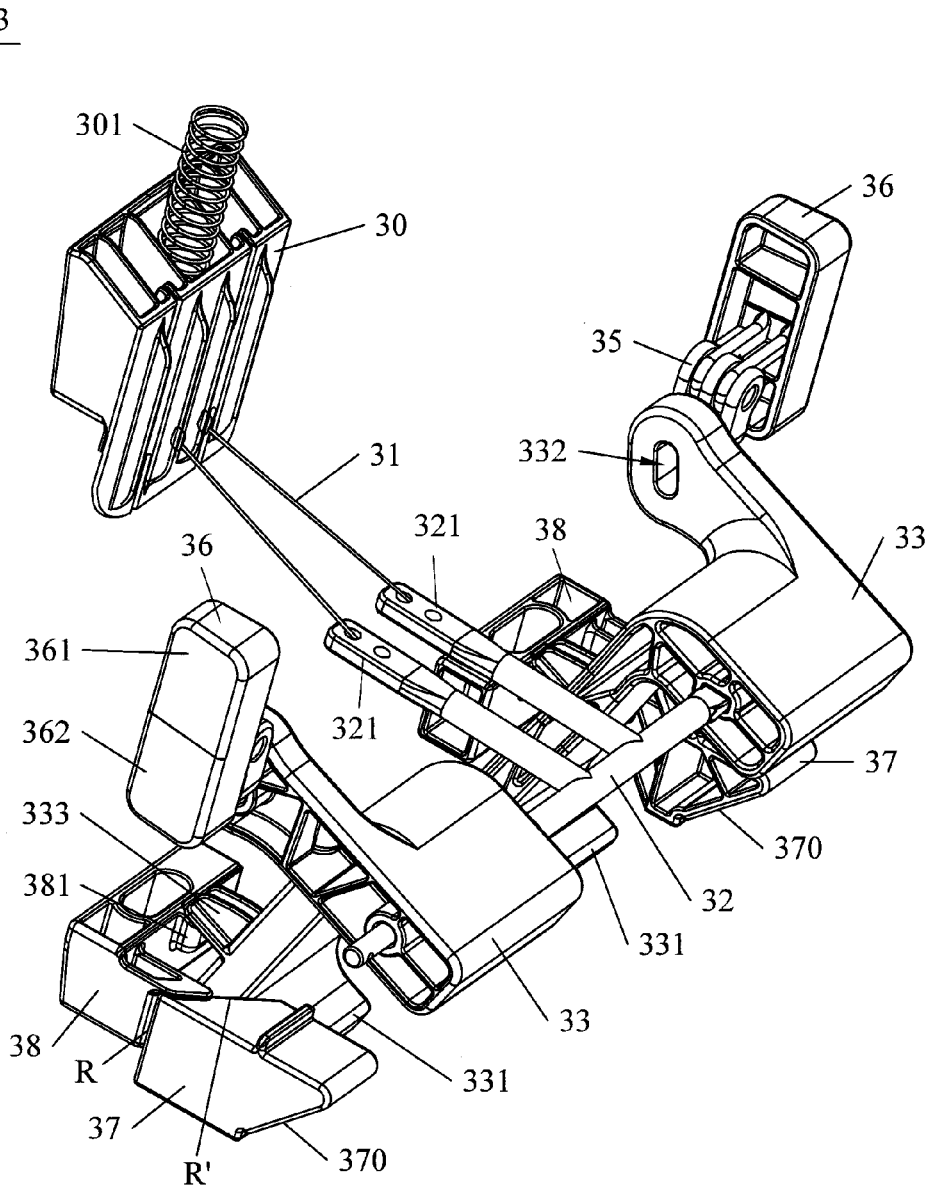
FIG. 5 is a schematic view illustrating the construction of one anchor mechanism.
Figure 6:
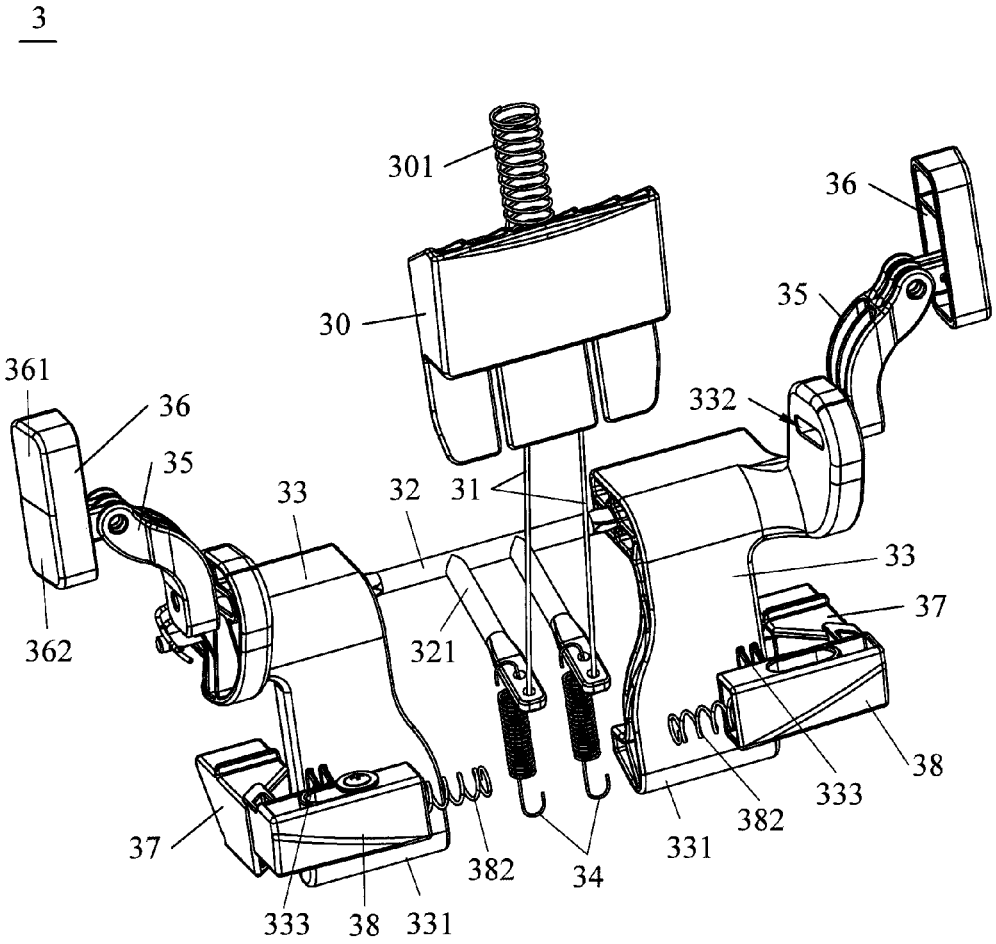
FIG. 6 is a schematic view illustrating the anchor mechanism of FIG. 5 under another angle of view.

Exemplary operation of the anchor mechanisms 3 is described hereafter with reference to FIGS. 1, 2, 5, 6 and 9. Referring to FIGS. 2, 5 and 6, when the infant carrier 2 is not installed on the seat portion 10, the actuator members 37 are not subject to any pressure from the seat portion 10. Accordingly, the biasing action applied by the springs 382 can keep the detents 38 in a state in which the protrusions 381 thereon respectively contact and engage with the underside of the protrusions 333 on the engaging arms 33, which can block a locking rotation of the engaging arms 33. As a result, the engaging arms 33 can be kept in the unlocking state. For installing the infant carrier 2 on the seat portion 10, a caregiver thus does not need to operate the release member 30 for unlocking the anchor mechanisms 3.

Figure 9:
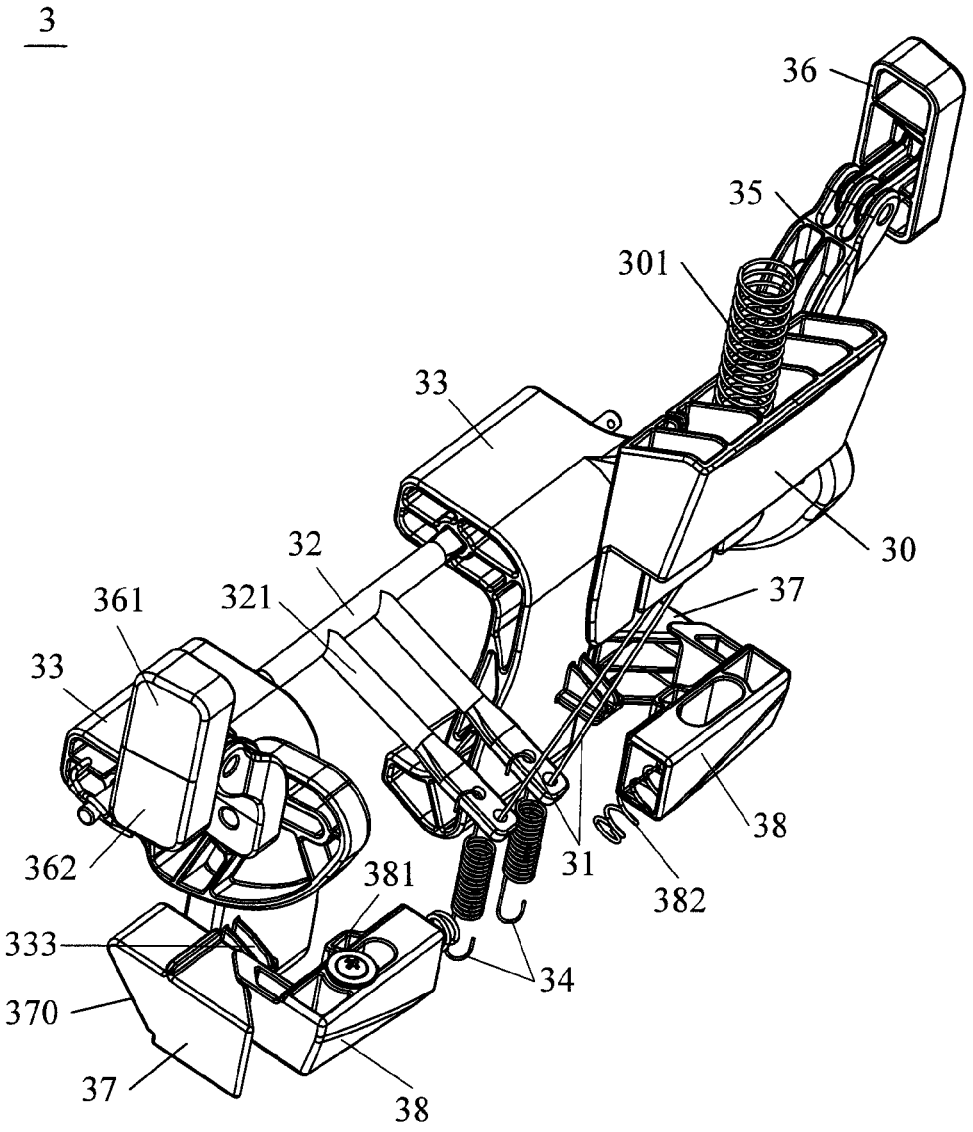
FIG. 9 is a schematic view illustrating the anchor mechanism of FIG. 5 in a locking state.

Referring to FIGS. 1 and 9, for installing the infant carrier 2 on the seat portion 10, the infant carrier 2 can be placed above the infant chair 1 and then lowered toward the seat portion 10. The infant carrier 2 can be positioned such that the head region H and the foot region F are respectively located at the left and right side of the infant chair 1 (i.e., corresponding to the sides of the left and right arms of a child that sits on the seat portion 10), so that a lengthwise axis of the infant carrier 2 extends transversal relative to the infant chair 1. Alternatively, the infant carrier 2 may also be positioned such that the head region H and the foot region F are respectively located at the right and left side of the infant chair 1. While the infant carrier 2 is lowered, the bevel surfaces 370 of the actuator members 37 can respectively contact against the seat portion 10, which can push the actuator members 37 to slide generally horizontal toward the interior of the lower shell portion 21. Owing to the respective sliding contact between the ramp surfaces of the actuator members 37 and those of the detents 38, the inward displacement of the actuator members 37 can cause the detents 38 to slide toward each other and compress the springs 382, which can disengage the protrusions 381 from the underside of the protrusions 333 of the engaging arms 33. The obstruction created by the protrusions 381 of the detents 38 is thereby removed, and the engaging arms 33 then can rotate concurrently to engage the hooks 331 with the seat portion 10 under the biasing action applied by the springs 34 on the rotary shaft 32. The hooks 331 of the engaging arms 333 can respectively engage, e.g., with recesses, openings or gaps provided in the seat portion 10 under its upper seat surface. The infant carrier 2 can be thereby locked with the infant chair 1 in a transversally or sideways oriented position.

As the engaging arms 33 are rotationally switched to the locking state, the protrusions 333 can be displaced to respectively lie at the positions left by the protrusions 381. As long as the engaging arms 33 remain in the locking state, the biasing action applied by the springs 382 on the detents 38 can then cause the protrusions 381 to respectively abut against side edges of the protrusions 333.

For removing the infant carrier 2 from the seat portion 10, the release member 30 can be displaced upward, which pulls on the link members 31 and drives the rotary shaft 32 and the engaging arms 33 to rotate for disengaging the hooks 331 from the seat portion 10. As the engaging arms 33 are switched to the unlocking state, the protrusions 333 disengage from the side edges of the protrusions 381. With the engaging arms 33 in the unlocking state, the infant carrier 2 can be removed from the seat portion 10, so that the bevel surfaces 370 of the actuator members 37 are no longer pushed by the seat portion 10. As a result, the springs 382 then can urge the detents 38 to their respective blocking positions for placing the protrusions 381 below the protrusions 333. The abutment of the protrusions 381 of the detents 38 under the protrusions 333 can block rotation of the engaging arms 33 toward the locking state, and the engaging arms 33 can be thereby kept in the unlocking state.

It is worth noting that the lower shell portion 21 can include two lobes 211 protruding downward where the engaging arms 33 of the two anchor mechanisms 3 can be arranged. Moreover, the two actuator members 37 in the two anchor mechanisms 3 can respectively project outward from the two lobes to face each other. Each actuator member 37 can extend outward by a length that is greater than the extending length of the hook 331 in the unlocking state. Accordingly, when the infant carrier 2 is installed on the seat portion 10, the hooks 331 would not hinder the push contact between the seat portion 10 and the ends of the actuator members 37.

FIGS. 10-14 are schematic views illustrating a second embodiment of an infant carrier provided with two different anchor mechanisms 4 and 4'.

Figure 12:
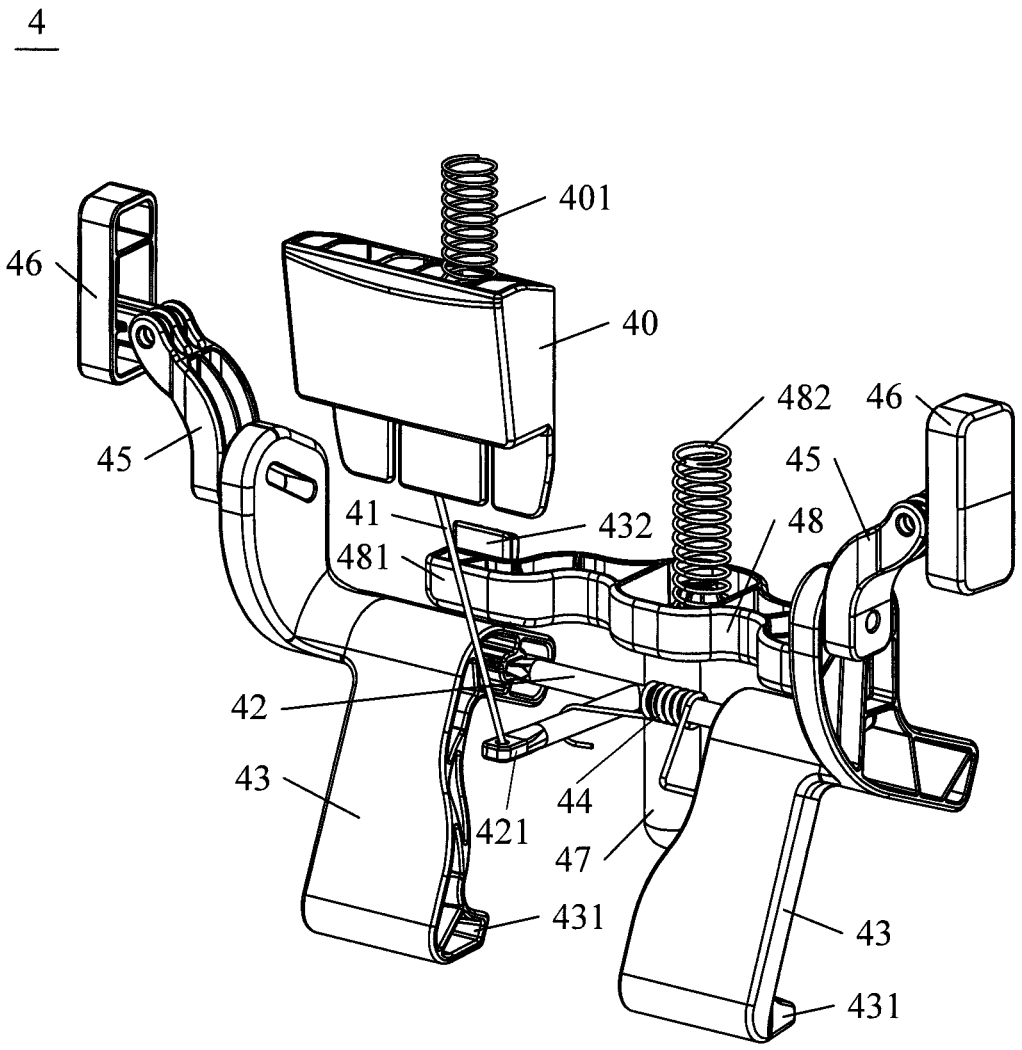
FIG. 12 is a schematic view illustrating a first anchor mechanism provided in the infant carrier shown in FIG. 10.
Figure 13:
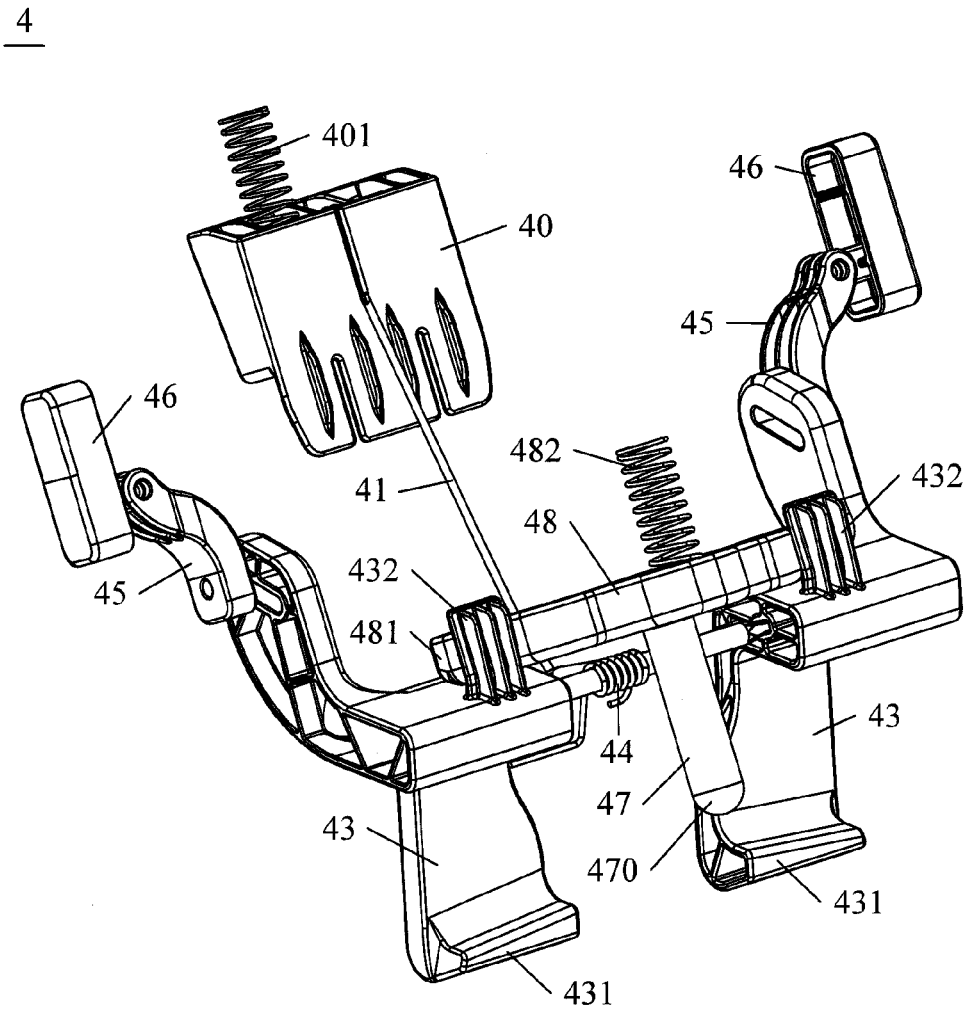
FIG. 13 is a schematic view illustrating the first anchor mechanism of FIG. 12 under another angle of view.

Referring to FIGS. 12 and 13, the anchor mechanism 4 can include a release member 40, a spring 401, a link member 41, a rotary shaft 42, two engaging arms 43, a torsion spring 44, two linkage parts 45, two state indicator members 46, and a detent assembly comprised of a detent 48 affixed with a post 47.

The assembly of the release member 40, the spring 401 and the rotary shaft 42 in the lower shell portion 21, and the connection of the link member 41 between the release member 40 and the rotary shaft 42 can be similar to the embodiment described previously. Moreover, the construction, assembly and operation of the state indicator members 46 and linkage parts 45 can also be similar to the previous embodiment.

In this embodiment, there is only one link member 41 connected between the release member 40 and the rotary shaft 42. The torsion spring 44 can wrap around the rotary shaft 42, a first end of the torsion spring 44 being anchored with the lower shell portion 21, and a second end of the torsion spring 44 hooking on the radial extension 421 of the rotary shaft 42. The torsion spring 44 can bias the rotary shaft 42 to rotate in a direction for causing the engaging arms 43 to engage and lock with the seat portion 10.

The assembly of the engaging arms 43 with the rotary shaft 42 is similar to the previous embodiment. Each engaging arm 43 can have a lower portion that bends to form a hook 431, and an upper portion that includes a protrusion 432 projecting upward at a position eccentric from the axis of the rotary shaft 42.

Figure 10:
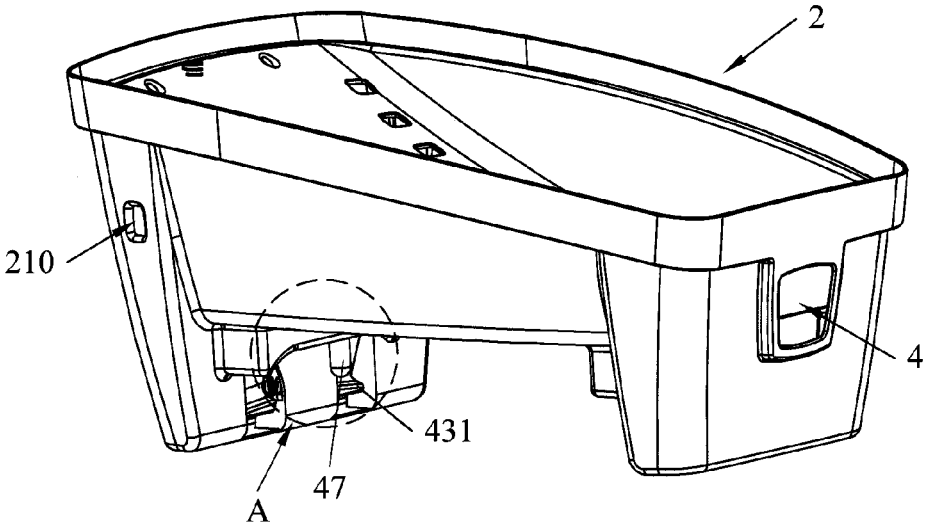
FIG. 10 is a schematic view illustrating another embodiment of an infant carrier provided with two different anchor mechanisms operable to engage with an infant chair.
Figure 11:
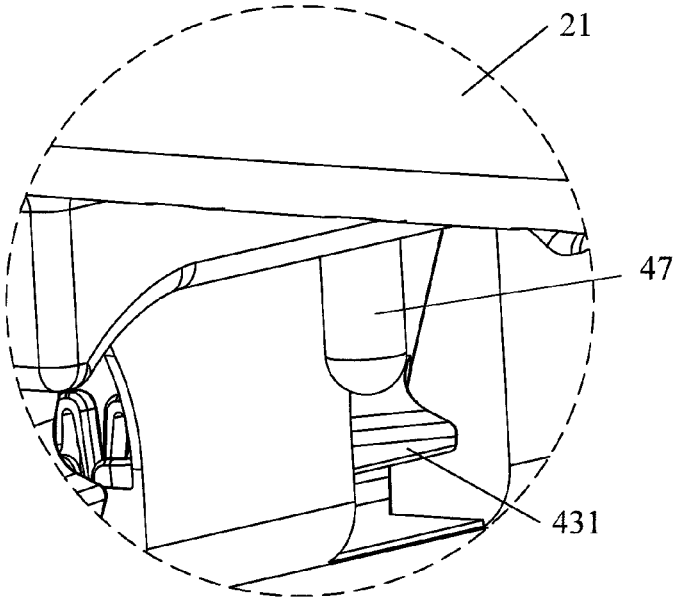
FIG. 11 is an enlarged view illustrating portion A shown in FIG. 10.

Referring to FIGS. 10 and 11, the detent assembly of this embodiment includes a detent 48 affixed with a post 47. The post 47 can be arranged at a forward position with respect to the hooks 431, and the two engaging arms 43 can be positioned symmetrical to each other relative to the post 47. A lower end of the post 47 can extend outside the lower shell portion 21, and can form a curved surface 470. In one embodiment, the curved surface 470 can be exemplary a half sphere.

The detent 48 can be affixed with an upper end of the post 47. In one embodiment, the detent 48 and the post 47 may be formed as an integral body. In another embodiment, the post 47 may be a separate part that is fixedly attached to the detent 48. The detent 48 can extend generally alongside the rotary shaft 42, and can bend to form two abutting portions 481. The two abutting portions 481 can be located at two sides of the post 47, and can respectively contact with a rear surface of the protrusions 432 behind the post 47 to block rotation of the rotary shaft 42 and the engaging arms 43 in a locking direction. Moreover, the detent 48 can limit a downward displacement of the post 47 to prevent its total separation from the lower shell portion 21.

When the infant carrier 2 is not installed on the seat portion 10, the post 47 can project downward outside the lower shell portion 21 at least by gravity action. While the post 47 is in this position, the abutting portions 481 of the detent 48 can respectively abut against the rear surfaces of the protrusions 432 of the engaging arms 43 behind the post 47. Accordingly, rotation of the rotary shaft 42 in the locking direction can be blocked, and the engaging arms 43 can be kept in the unlocking state.

Referring to FIG. 13, a spring 482 can be respectively connected with an upper side of the detent 48 and the shell body of the infant carrier 2 (e.g., the upper shell portion 22). The spring 482 can urge the detent 48 and the post 47 downward for positioning the abutting portions 481 in abutment with the rear surfaces of the protrusions 432.

Like previously described, the two linkage parts 45 can respectively connect the two state indicator members 46 to the two engaging arms 43. The state indicator members 46 can be respectively driven in movement by the engaging arms 43 via the connection of the two linkage parts 45 to visually indicate whether the engaging arms 43 are in the unlocking or locking state.

In alternate embodiments not shown, the linkage parts 45 may be omitted, and the two state indicator members 46 can be slidably assembled with the lower shell portion 21 and further respectively connect pivotally with two opposite end portions integrally formed with the detent 48. An upward displacement of the detent 48 and the post 47 can thereby drive the state indicator members 46 to slide for indicating a locking state.

For installing the infant carrier 2 on the seat portion 10, the infant carrier 2 can be placed above the infant chair 1 in a transversally or sideways oriented configuration and then lowered toward the seat portion 10. While the infant carrier 2 is lowered, the curved surface 470 of the post 47 can contact against the seat portion 10, which can push the post 47 to slide vertically upward toward the interior of the lower shell portion 21. This inward displacement of the post 47 can drive the detent 48 to slide upward so as to disengage the abutting portions 481 from the rear of the protrusions 432. The obstruction created by the abutting portions 481 of the detent 48 is thereby removed, and the engaging arms 43 then can rotate concurrently to engage the hooks 431 with the seat portion 10 under the biasing action applied by the torsion spring 44 on the rotary shaft 42. As the engaging arms 43 are rotationally switched to the locking state, the protrusions 432 can be displaced to respectively lie at the positions left by the abutting portions 481. As long as the engaging arms 43 remain in the locking state, the biasing action applied by the springs 482 on the detent 48 can then cause the abutting portions 481 to respectively abut against upper edges of the protrusions 432.

For removing the infant carrier 2 from the seat portion 10, the release member 40 can be displaced upward, which pulls on the link member 41 and drives the rotary shaft 42 and the engaging arms 43 to rotate for disengaging the hooks 431 from the seat portion 10. As the engaging arms 43 are rotationally switched to the unlocking state, the protrusions 432 respectively disengage from the underside of the abutting portions 481. With the engaging arms 43 in the unlocking state, the infant carrier 2 can be removed from the seat portion 10, so that the curved surface 470 of the post 47 no longer contacts against the seat portion 10. As a result, the springs 482 can urge the detent 48 to displace the abutting portions 481 downward to their respective blocking positions at the rear of the protrusions 432. The abutment of the abutting portions 481 behind the protrusions 432 can block rotation of the engaging arms 43 toward the locking state, and the engaging arms 43 can be thereby kept in the unlocking state.

Figure 14:
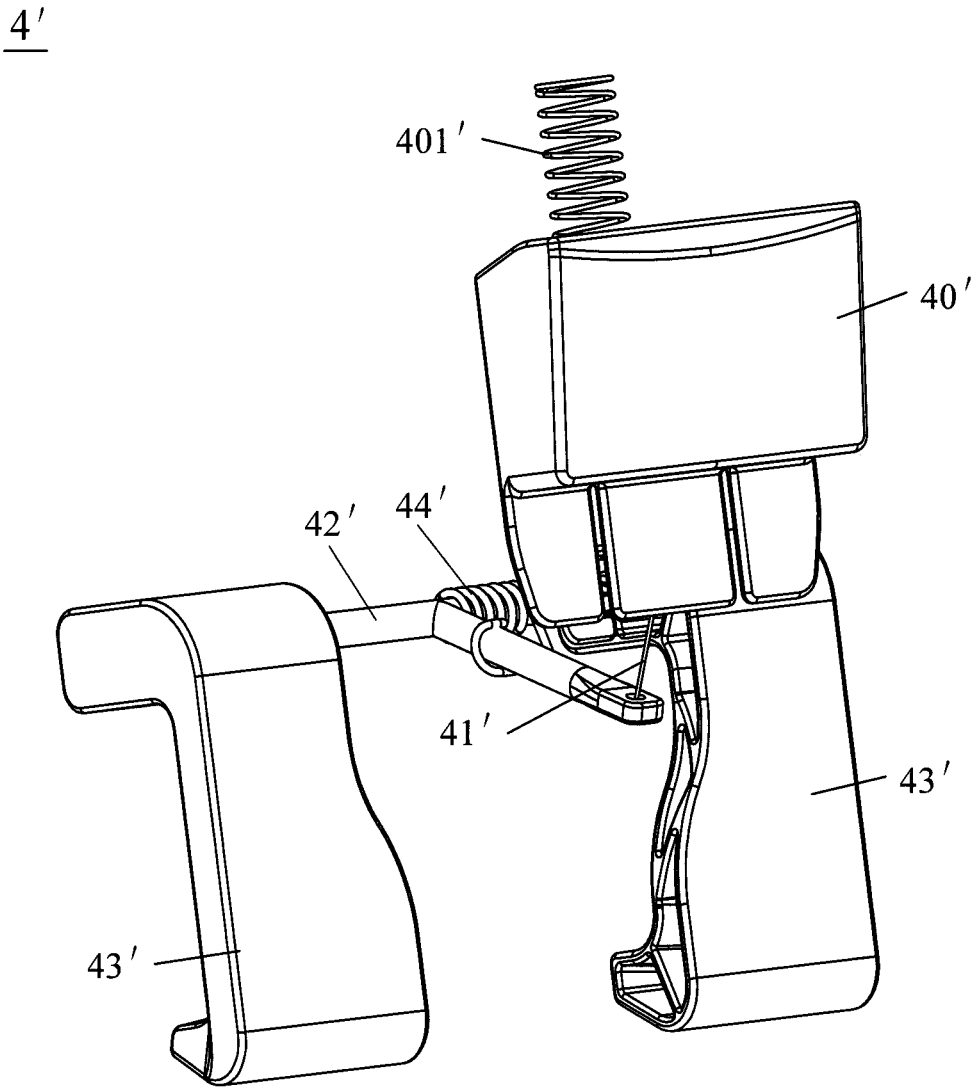
FIG. 14 is a schematic view illustrating a second anchor mechanism provided in the infant carrier shown in FIG. 10.

Referring to FIG. 14, the other anchor mechanism 4' can include a release member 40', a spring 401', a link member 41', a rotary shaft 42', two engaging arms 43' and a torsion spring 44'. The structure and assembly of these elements of the anchor mechanism 4' are similar to those of the release member 40, the spring 401, the link member 41, the rotary shaft 42, the two engaging arms 43 and the torsion spring 44 of the anchor mechanism 4 described previously. The torsion spring 44' can rotationally bias the rotary shaft 42' to effect locking engagement of the engaging arms 43' with the seat portion 10. However, unlike the anchor mechanism 4, the anchor mechanism 4' is configured to always recover the locking state after actuation of the release member 40', and cannot self-maintain the unlocking state after removal from the seat portion 10 (i.e., no detent assembly is provided in the anchor mechanism 4').

Figure 15:
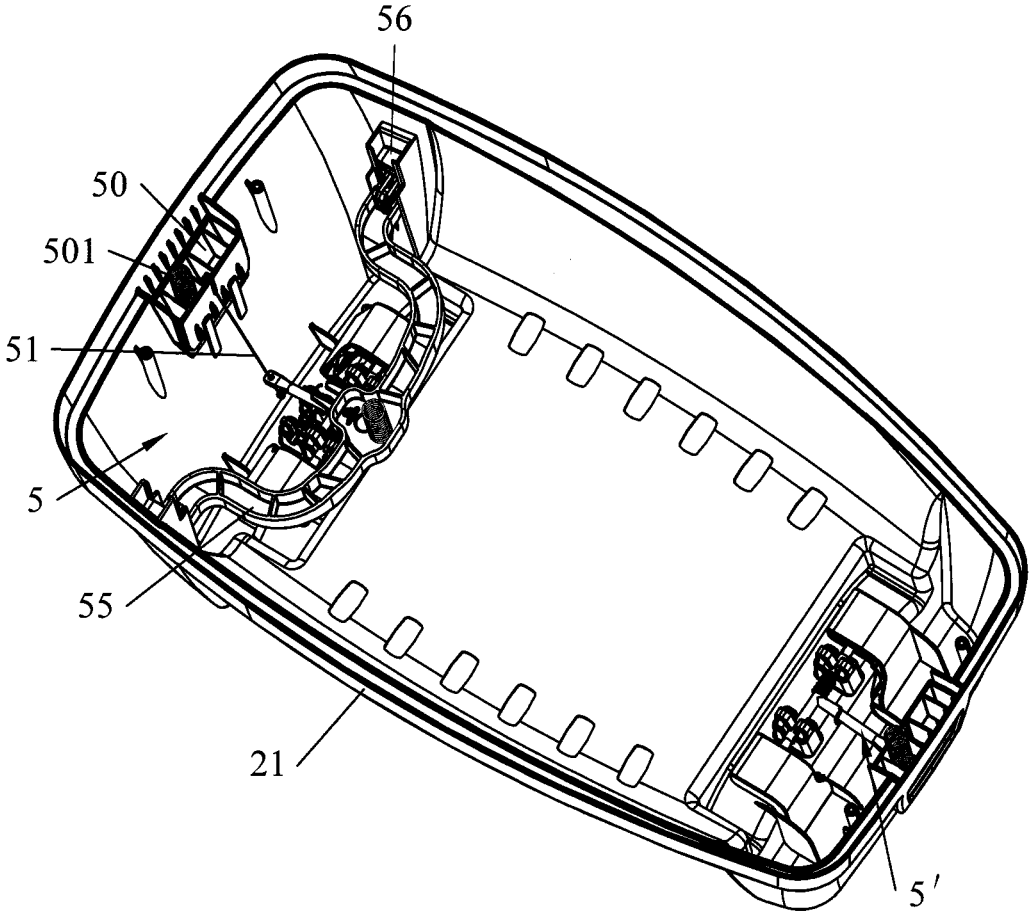
FIG. 15 is a schematic view illustrating another embodiment of an infant carrier provided with two other different anchor mechanisms operable to engage with an infant chair.
Figure 16:
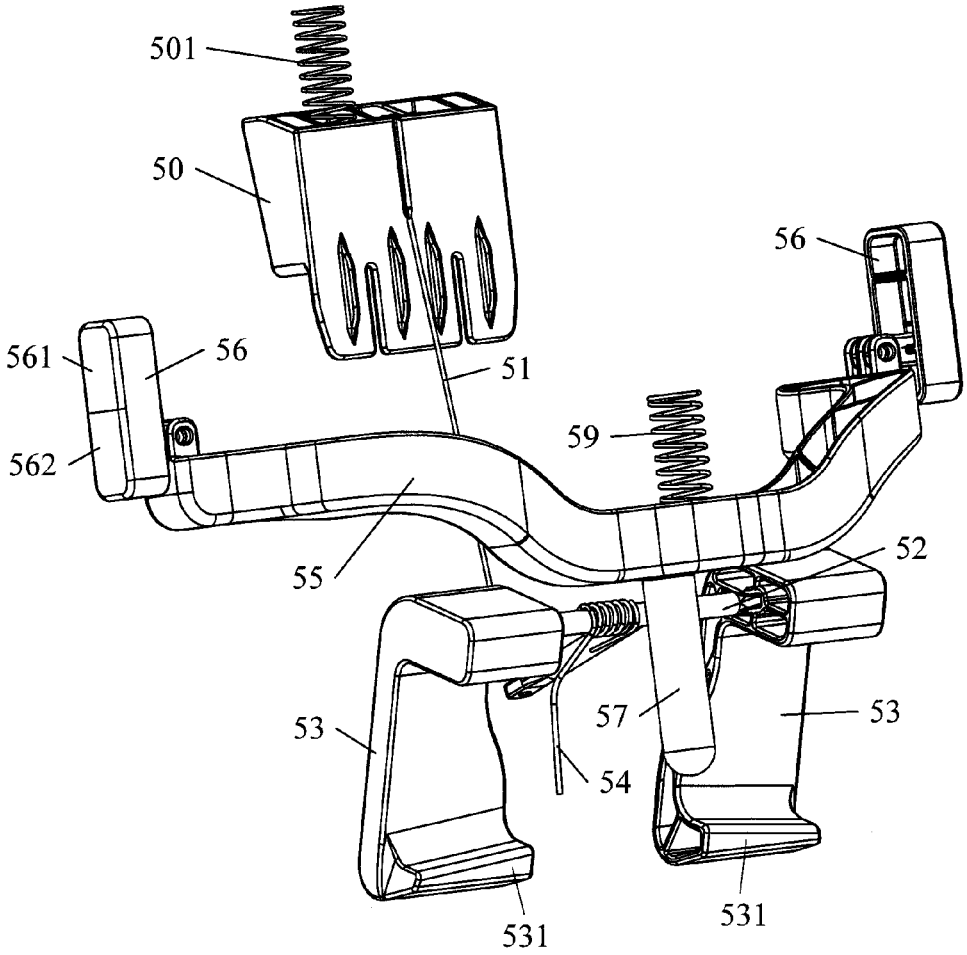
FIG. 16 is a schematic view illustrating one of the two anchor mechanisms provided in the infant carrier shown in FIG. 15.
Figure 17:
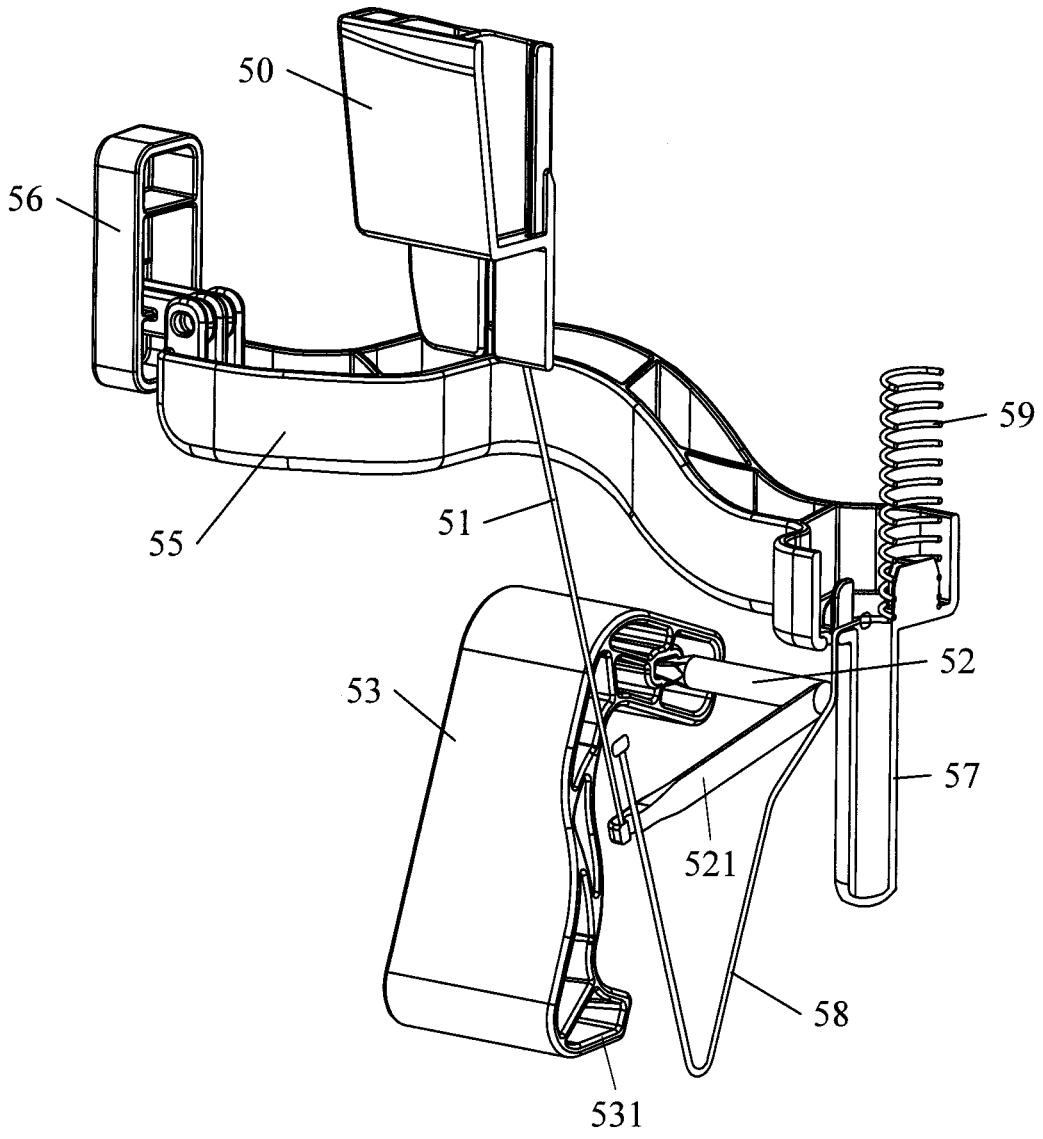
FIG. 17 is a schematic view illustrating the anchor mechanism of FIG. 16 under another angle of view.

FIGS. 15-17 are schematic views illustrating a third embodiment of an infant carrier provided with two different anchor mechanisms 5 and 5'. The anchor mechanism 5' is similar to the anchor mechanism 4' described previously.

The anchor mechanism 5 can include a release member 50, a spring 501, a link member 51, a rotary shaft 52, two engaging arms 53, a torsion spring 54, a linkage part 55, two state indicator members 56, a post 57 and another link member 58. The release member 50, the spring 501, the link member 51 and the rotary shaft 52 can be assembled like the release member 40, the spring 401, the link member 41 and the rotary shaft 42 of the anchor mechanism 4 described previously.

The two engaging arms 53 can have upper portions respectively affixed with two opposite ends of the rotary shaft 52, and lower bent portions that form hooks 531. Unlike the previous embodiments, no inclined slots are provided in the engaging arms 53 for connecting with the state indicator members 56.

The torsion spring 54 wraps around the rotary shaft 52. The torsion spring 54 has a first end connected with the lower shell portion 21, and a second end connected with the radial extension 521 of the rotary shaft 52. The torsion spring 54 can rotationally bias the rotary shaft 52 in a direction for unlocking the engaging arms 52 from the seat portion. In other words, when the infant carrier is not installed on the infant chair, the spring action of the torsion spring 54 can maintain the engaging arms 52 in the unlocking state.

The post 57 can be arranged at a forward position with respect to the hooks 531 of the engaging arms 53, and the two engaging arms 53 can be transversally positioned symmetrical to each other relative to the post 57. The post 57 can have a lower and an upper end, the lower end of the post 57 extending outside the lower shell portion 21.

The linkage part 55 can be affixed with the upper end of the post 57, and can extend alongside the rotary shaft 52 toward two opposite sides of the lower shell portion 21. The two state indicator members 56 can be respectively connected pivotally with two ends of the linkage part 55. Each of the state indicator members 56 can have a surface provided with two visually distinctive regions 561 and 562 that are disposed on top of each other. The upper region 561 can have red color, and the lower region 562 can have green color.

A spring 59 can be respectively connected with the post 57 and the shell body of the infant carrier 2 (e.g., the upper shell portion 22). The spring 59 can bias the post 57 downward to cause it projecting outside the lower shell portion 21.

When the infant carrier 2 is not installed on the infant chair 1, the post 57 can project downward outside the lower shell portion 21 at least by gravity action. The linkage part 55 can be displaced downward along with the post 57, which causes the red color of the region 561 on each state indicator member 56 to display through the corresponding display window (e.g., display window 210 as shown in FIG. 3) for indicating the unlocking state of the engaging arms 53. After the infant carrier 2 is installed on the infant chair 1, the post 57 in contact with an upper surface of the seat portion 10 is pushed toward the interior of the lower shell portion 21 against the spring force applied by the spring 59, which displaces the linkage part 55 upward and causes the green color of the region 562 on each state indicator member 56 to display through the corresponding display window for indicating the locking state of the engaging arms 53.

The link member 58 can be exemplary a wire or cable. The link member 58 can have a first end connected with the radial extension 521 of the rotary shaft 52, and a second end connected with the linkage part 55 at an upper region of the post 57. When it slides upward (i.e., occurring when the infant carrier 2 is installed on the infant chair 1), the post 57 can pull on the link member 58 and drive the rotary shaft 52 and the engaging arms 53 to overcome the spring force of the torsion spring 54 and rotate for engaging the hooks 531 with the seat portion 10. The lower shell portion 21 can further include one or more guiding axle, roller or pulley (not shown) around which the link member 58 can at least partially wrap to achieve the aforementioned drive transmission.

It is worth noting that if the radial extension 521 were fixedly anchored with the corresponding end of the link member 58, as long as the infant carrier 2 remains in place on the seat portion 10, rotation of the rotary shaft 52 and the engaging arms 53 in the unlocking direction may be substantially limited owing to the retracted position of the post 57 that tends to pull the post 57 downward. This may hamper an effective displacement of the release member 50 to unlock the engagement arms 53. To remedy this issue, the link member 58 can be slidably connected through the radial extension 521, and a buffer length of the link member 58 may be left between the radial extension 521 and the corresponding end of the link member 58. In this way, a relative displacement can occur between the link member 58 and the radial extension 521 to allow an effective unlocking rotation of the rotary shaft 52 and engaging arms 53 when the release member 50 is actuated.

With the anchor mechanisms described above, the infant carrier 2 can be securely attached on the infant chair 1. The engaging arms of the anchor mechanisms can engage with two opposite edges of an upper surface of the seat portion 10, or any other structure provided on the seat portion 10.

Figure 18:
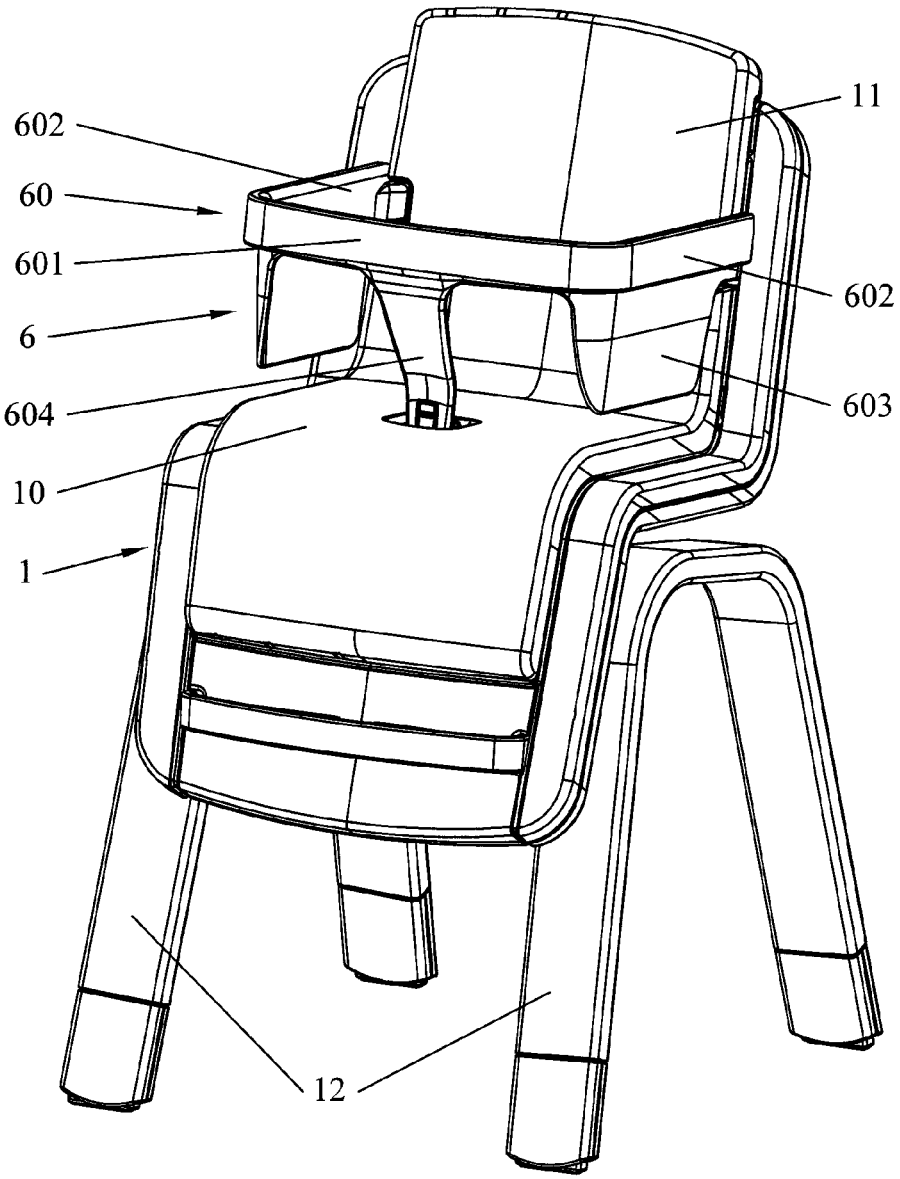
FIG. 18 is a schematic view illustrating an infant chair mounted with a guard member.
Figure 19:
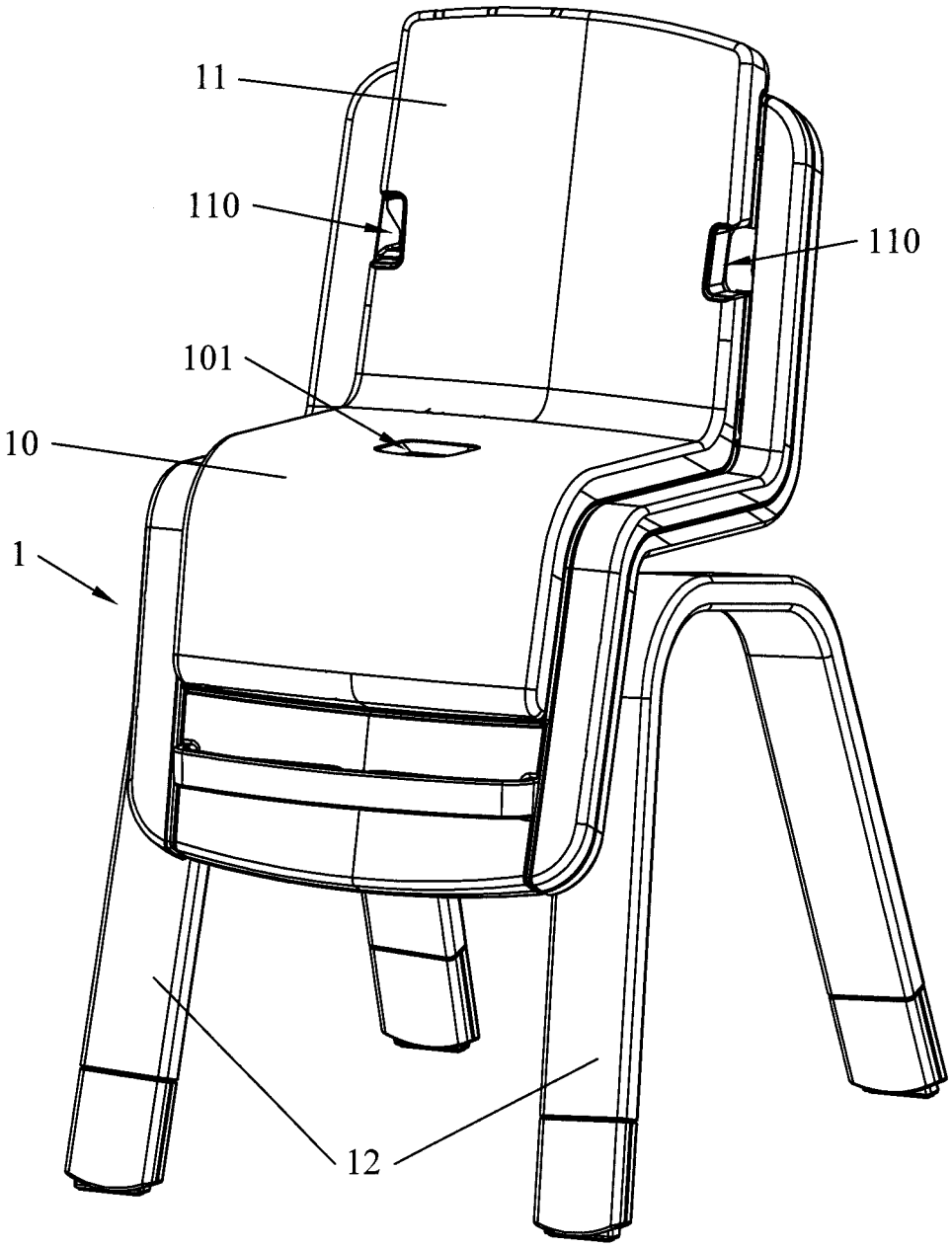
FIG. 19 is a schematic view illustrating the infant chair alone.

FIGS. 18 and 19 are schematic views illustrating an embodiment of an infant chair 1 provided with a guard member 6. The guard member 6 can have a U-shaped frame 60 including a front bar 601 and two side bars 602 respectively connected with two opposite ends of the front bar 601.

The U-shaped frame 60 can be opened at the side of the backrest 11. The U-shaped frame 60 can surround the sitting space of the infant chair 1, and can securely restrain a child sitting on the seat portion 10.

The guard member 6 can be installed in locking engagement with the backrest 11. More specifically, each of the respective distal ends of the two side bars 602 can be formed with a mount portion (not shown), and the backrest 11 can correspondingly have two connecting portions 110 that can receive the engagement of the two mount portions of the side bars 602 for locking the guard member 6 with the backrest 11. In one embodiment, the mount portions of the side bars 602 can be formed as locking fingers projecting toward the backrest 11, and the connecting portions 110 can include insert openings into which the locking fingers can slidably engage. In alternate embodiments, the mount portions of the side bars 602 can include insert openings, and the connecting portions 110 can be formed with locking fingers that can slidably engage with the insert openings. It will be understood that the mount portions of the side bars 602 and the connecting portions 110 of the backrest 11 are not limited to the aforementioned structures, can have any other constructions suitable to attach the guard member 6 with the backrest 11.

For a more secure arrangement of the guard member 6 on the infant chair 1, the side bars 602 can be respectively affixed with lateral plates 603, and the front bar 601 can be affixed with a support rod 604, the lateral plates 603 and the support rod 604 respectively projecting downward toward the seat portion 10 of the infant chair 1. The lateral plate 603 can prevent unsafe placement of the arms and legs of the child through the gap between the guard member 6 and the seat portion 10, which may cause clamping accidents. Moreover, the support rod 604 can positioned between the two legs of the child so as to prevent slipping of the child through the gap between the front bar 601 and the seat portion 10. Preferably, a lower end of the support rod 604 can have an insert (not shown), and the seat portion 10 can be formed with a socket 101 into which the insert can slidably engage to prevent slipping of the support rod 604 on the seat portion 10.

Figure 20:
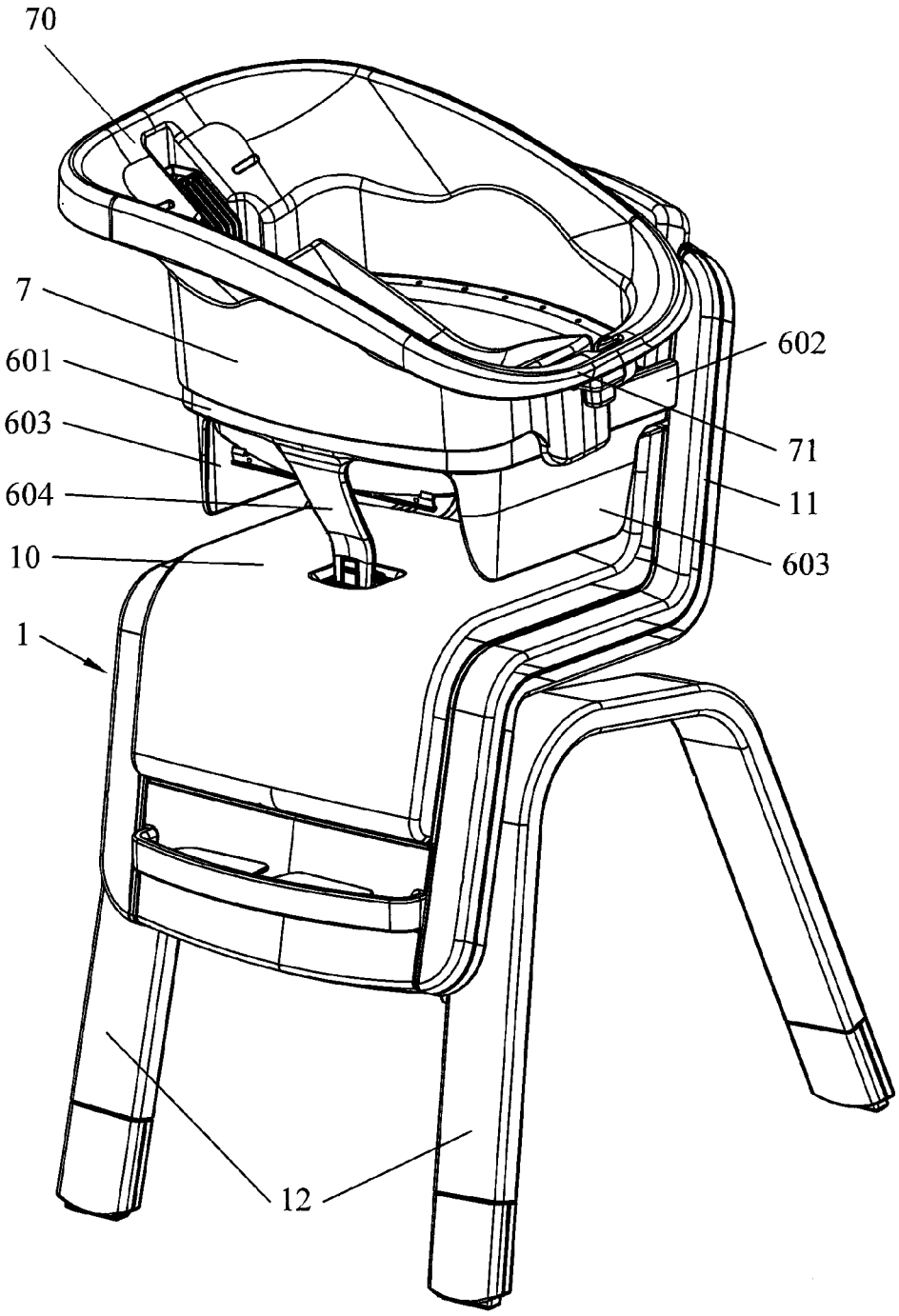
FIG. 20 is a schematic view illustrating an infant chair assembly including an infant carrier installed in a first configuration.
Figure 21:
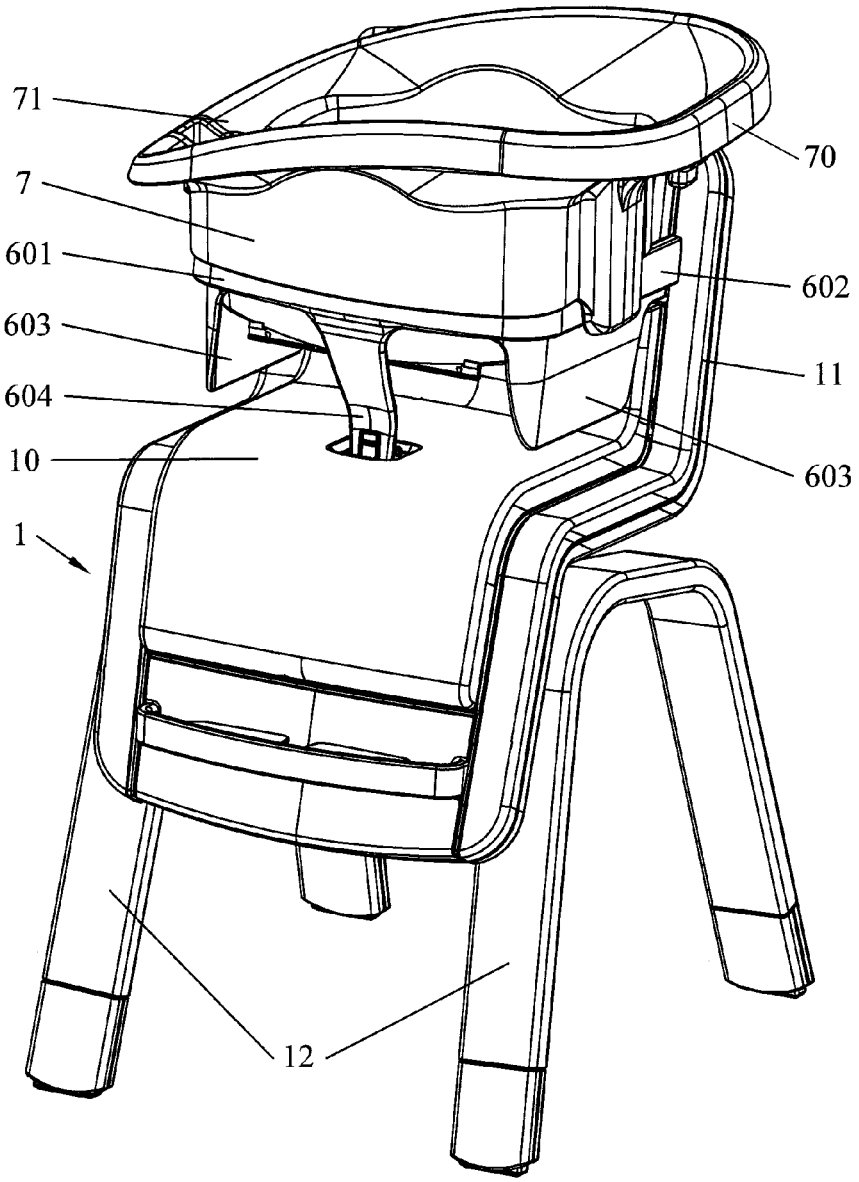
FIG. 21 is a schematic view illustrating an infant chair assembly including an infant carrier installed in a second configuration.
Figure 22:
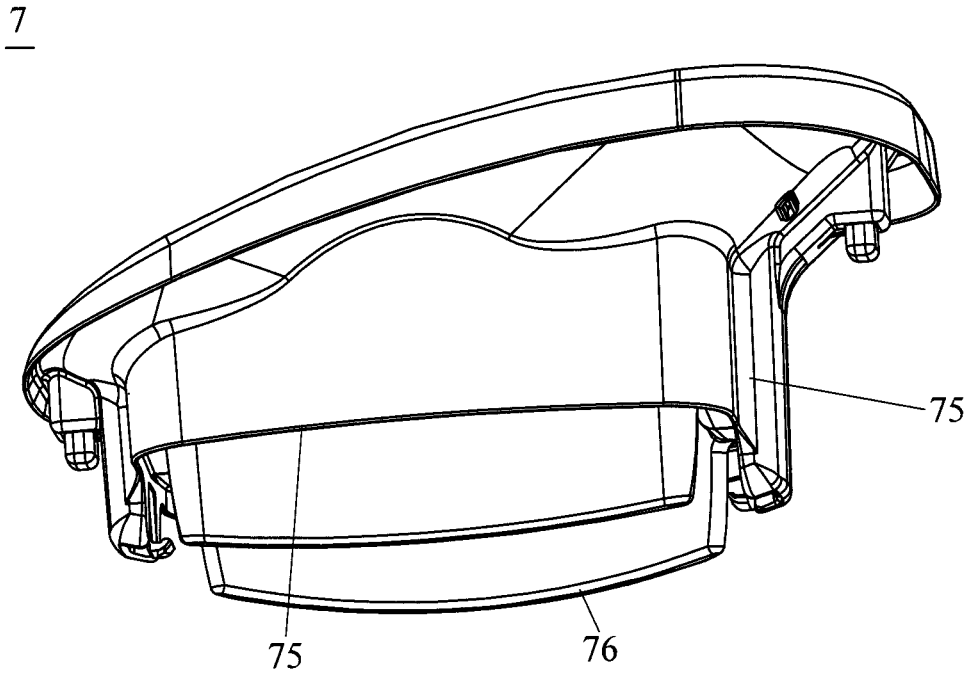
FIG. 22 is a schematic view illustrating the infant carrier provided with curved feet projecting downward.

FIGS. 20-22 are schematic views illustrating another embodiment in which the infant chair 1 is mounted with the guard member 6, and the infant carrier is a portable sleeping basket or crib 7 installed on the guard member 6. The crib 7 can be conveniently installed on the guard member 6 without a child received therein. The crib 7 can be thereby positioned in an elevated configuration facilitating care dispensing.

In one embodiment, the crib 7 can have a shape with four upper side edges, and two opposite upper side edges 70 and 71 of the crib 7 respectively corresponding to the side bars 602 of the guard member 6 can rise at different heights. In other words, once it is installed on the guard member 6 of the infant chair 1, the upper rim of the crib 7 can slope down from one of a left and a right side to the other one of the left and right side of the infant chair 1. The crib 7 can be installed with the higher portion of the upper rim at the left side of the infant chair 1 (as shown in FIG. 20), or at the right side of the infant chair 1 (as shown in FIG. 21). This inclined configuration of the crib 7 can allow a caregiver sitting at the left or right side of the infant chair 1 to more easily dispense care to the child in the crib 7.

The crib 7 can have a surrounding sidewall 75 that projects generally vertical and downward. The surrounding sidewall 75 can downwardly taper toward the U-shaped frame 60. Once the crib 7 is installed on the guard member 6, the surrounding sidewall 75 can elastically press inward against U-shaped frame 60 (e.g., against the upper edges of the front bar 601 and side bars 602).

Referring to FIG. 22, the crib 7 can further include curved feet 76 projecting downward at an inner side of the surrounding sidewall 75. When the crib 7 is used on a floor independently from the infant chair 1, the curved feet 76 can rock in contact with the floor surface, which can impart a rocking motion to the crib 7 to sooth the child.

One or two sides of the crib 7 can be provided with any of the anchor mechanisms described previously for fastening to the guard member 6. The engaging arms of the two anchor mechanisms can respectively engage with the underside of the two side bars 602 to lock the crib 7 in place on the guard member 6.

Figure 23:
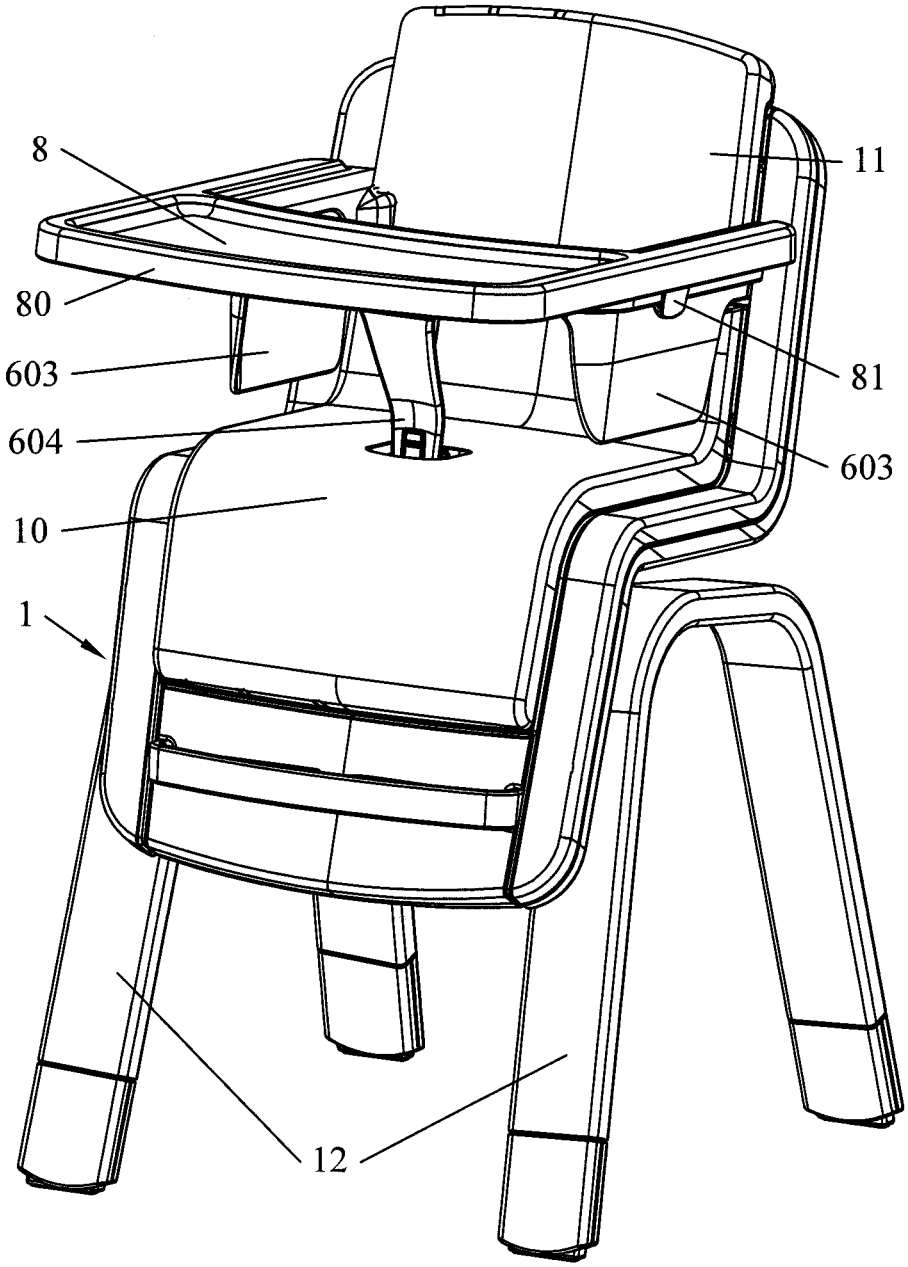
FIG. 23 is a schematic view illustrating the infant chair provided with a guard member mounted with a table.

Referring to FIG. 23, after the crib 7 is removed from the guard member 6, a table 8 can be installed on the guard member 6. The table 8 can have an outer sidewall that bends downward to form a lip 80. When the table 8 is installed on the U-shaped frame 60 of the guard member 6, the lip 80 can elastically deform so as to press against the outer edges of the front bar 601 and/or the side bars 602 for fixedly positioning the table 8. A caregiver can simply pull the table 8 upward to disengage the lip 80 from the U-shaped frame 60.

In one embodiment, the table 8 can be further provided with a latch 81 that can engage with the U-shaped frame 60 for locking the table 8 in place, and operatively disengage from the U-shaped frame 60 for removal of the table from the guard member 6. With the arrangement of the latch 81, there is no need for elastic engagement of the lip 80 with the U-shaped frame 60, and the table 8 can be installed and removed without effort.

Advantages of the structures described herein include the ability to removably install an infant carrier on an infant chair. The infant chair can be a high chair, and the infant carrier can be a crib, both of which may be used separately and independently from each other, thereby offering more flexibility in use. The installation of the infant carrier on the infant chair at an elevated position can facilitate care dispensing to a child placed in the infant carrier. This assembly may be used as a substitute of a standalone bassinet, which can avoid the need of purchasing and storing another device in a house.

Realizations of the infant chairs, infant carriers, and assemblies thereof have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant carrier comprising:

a shell body adapted to be placed on an infant chair, the shell body having two lobes protruding downward at two opposite sides of the shell body; and a first and a second anchor mechanism respectively disposed adjacent to the two lobes and operable to fasten with the infant chair, each of the first and second anchor mechanisms respectively including:

a rotary shaft pivotally connected with the shell body;

a release member movably connected with the shell body, the release member being operatively connected with the rotary shaft; and two engaging arms affixed with the rotary shaft, the two engaging arms respectively having hooks operable to engage with the infant chair for locking the infant carrier in place on the infant chair;

a detent assembly comprising at least one detent movably supported on the shell body for movement into and out of locking engagement with at least one of the engaging arms and at least one actuator member movably supported on the shell body and movably engaged with the detent to move the detent out of said locking engagement, wherein the actuator member comprises an end extending outside the shell body, the end of the actuator member being adapted for engagement by a portion of the child seat when the infant carrier is engaged with the child seat, and wherein engagement of the end of the actuator member moves the actuator member and in turn the detent to unlock the engaging arms; and wherein the two lobes are separated by a space configured to receive a portion of an infant chair when the infant carrier is installed on the infant chair, the hooks of the first and second anchor mechanisms being respectively operable to engage with the portion of the infant chair positioned in the space between the two lobes, and actuation of the release member drives the rotary shaft and the engaging arms to rotate for disengaging the hooks from the infant chair.

2. The infant carrier according to claim 1, wherein in the first anchor mechanism, the rotary shaft has a radial extension, and the release member is connected with the radial extension of the rotary shaft via a link member.

3. The infant carrier according to claim 2, wherein in the first anchor mechanism, the hooks protrude to one side of the rotary shaft, the release member is disposed at another side of the rotary shaft opposite to that of the hooks, and the radial extension projects generally perpendicular to the rotary shaft toward the side of the release member.

4. The infant carrier according to claim 1, wherein the first anchor mechanism further includes a first spring respectively connected with the shell body and the radial extension of the rotary shaft for rotationally biasing the rotary shaft.

5. The infant carrier according to claim 1, wherein the first anchor mechanism further includes a state indicator member and a linkage part, the state indicator member being slidably connected with the shell body and movable to visually indicate whether the first anchor mechanism is in a locking or an unlocking state, the linkage part having a first and a second end, the first end being slidably connected with an inclined slot provided on one of the engaging arms of the first anchor mechanism, and the second end of the linkage part being pivotally connected with the state indicator member.

6. The infant carrier according to claim 1, wherein in the first anchor mechanism, an end of the rotary shaft is affixed with a state indicator member, the state indicator member being configured to visually indicate whether the first anchor mechanism is in a locking or an unlocking state.

7. The infant carrier according to claim 1, wherein, the detent is biased by a spring to a blocking position adjacent to one of the engaging arms, thereby preventing rotation of the rotary shaft and the engaging arms of the first anchor mechanism in a locking direction when in the locking engagement.

8. The infant carrier according to claim 7, wherein the actuator member has a bevel surface inclined downward, the actuator member and the detent are in sliding contact with each other via ramp surfaces, and a sliding displacement of the actuator member toward an interior of the shell body drives the detent to slide generally alongside the rotary shaft of the first anchor mechanism away from the blocking position for allowing rotation of the rotary shaft and the engaging arms of the first anchor mechanism in the locking direction.

9. The infant carrier according to claim 1, wherein the infant carrier is a portable basket having a foot region and a head region, and the first and second anchor mechanisms are respectively disposed near the foot region and the head region of the infant carrier.

* * * * *